United States Patent [19]

Waldhauser et al.

[11] Patent Number: 4,492,002

[45] Date of Patent: Jan. 8, 1985

[54] FLOOR CLEANING MACHINE

[75] Inventors: Steven J. Waldhauser, Niagara Falls, N.Y.; Dennis J. Corneil, Toronto, Canada

[73] Assignee: Wetrok, Inc., Niagara Falls, N.Y.

[21] Appl. No.: 487,503

[22] Filed: Apr. 22, 1983

Related U.S. Application Data

[62] Division of Ser. No. 186,420, Sep. 12, 1980, Pat. No. 4,380,844.

[51] Int. Cl.[3] ..... A47L 11/30

[52] U.S. Cl. ..... 15/320; 15/401

[58] Field of Search ..... 15/320, 401, 50 R

[56] References Cited

U.S. PATENT DOCUMENTS

| | | | |
|---|---|---|---|
| 3,290,716 | 12/1966 | Cain | 15/353 |
| 3,345,671 | 10/1967 | Wilson et al. | 15/320 |
| 3,496,591 | 2/1970 | Sheler | 15/320 |
| 3,649,995 | 3/1972 | Ison | 15/320 |
| 3,837,029 | 9/1974 | Kasper | 15/50 C |
| 3,879,789 | 4/1975 | Kasper | 15/50 C |
| 4,006,506 | 2/1977 | Burgoon | 15/50 R |
| 4,037,289 | 7/1977 | Dojan | 15/320 |
| 4,173,056 | 11/1979 | Geyer | 15/320 |

OTHER PUBLICATIONS

26" Automatic Scrubbervac—The Kent Company.

Floor Scrubbing—Clarke-Gravely Corporation.

432 Scrubber—Tennant Company—Copyright 1980.

520 Power Scrubber—Tennant Company—Bulletin 520-1, Copyright 1971.

*Primary Examiner*—Chris K. Moore

*Attorney, Agent, or Firm*—Christel, Bean & Linihan

[57] ABSTRACT

An automatic floor cleaning machine includes a unitary, self-contained and propelled, power driven body mounting from front to rear in a normal cleaning direction of travel: a propulsion mechanism including drive wheels and guide wheels for dry tracking on the floor surface to be cleaned, a scrubber mechanism including a pair of rearwardly disposed, vertically articulated counter-rotating magnetically and floatably mounted brushes for wetting and cleaning such floor surface, a vacuum mechanism including a vertically and horizontally articulated quick-detachable squeegee for drying of and proper tracking on the cleaned surface, and a combined mechanical and electrical control system operatively associated with each of such propulsion, scrubber and vacuum mechanisms, for convenient actuation by a walk-behind operator to control actuation of such machine. Preferably, a sweeper mechanism is mounted on the body forwardly of the propulsion mechanism and operatively associated with such control system for advance sweeping of a debris-laden floor surface.

5 Claims, 21 Drawing Figures

Fig. 7.
Fig. 5.
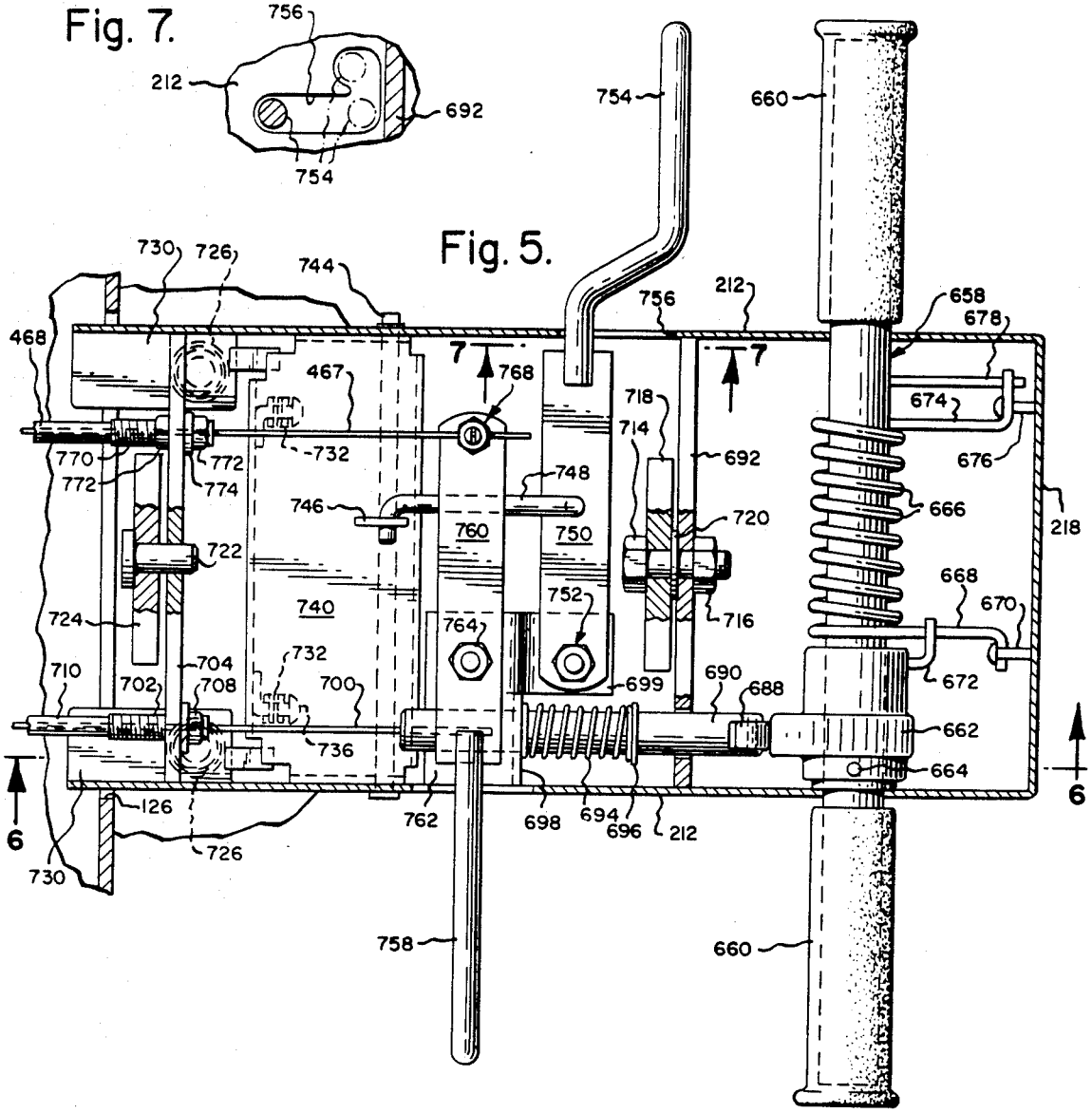
Fig. 6.
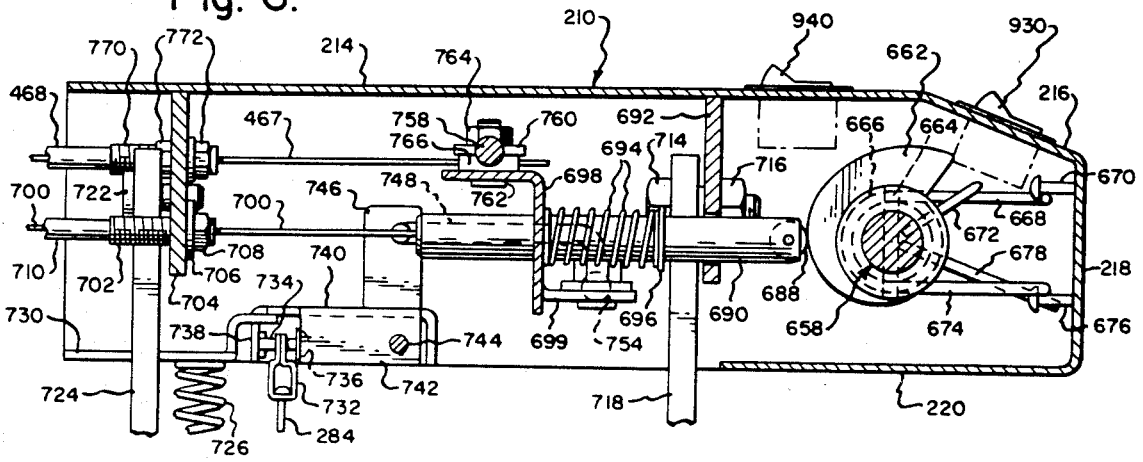

Fig. 8.
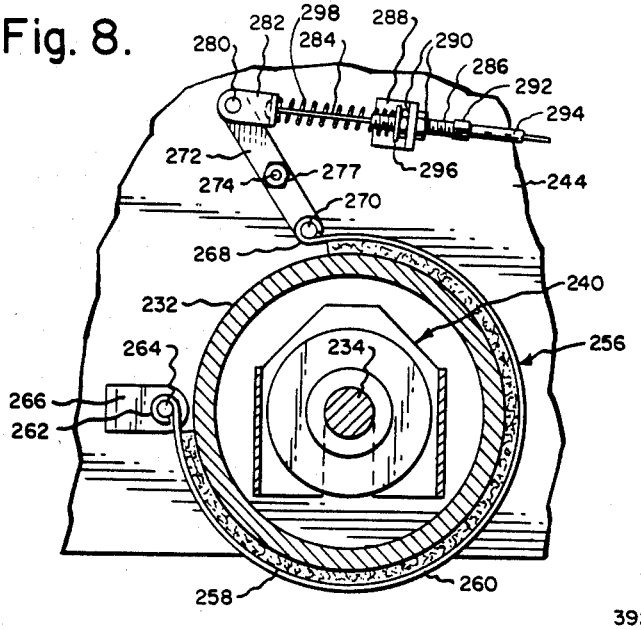
Fig. 9.
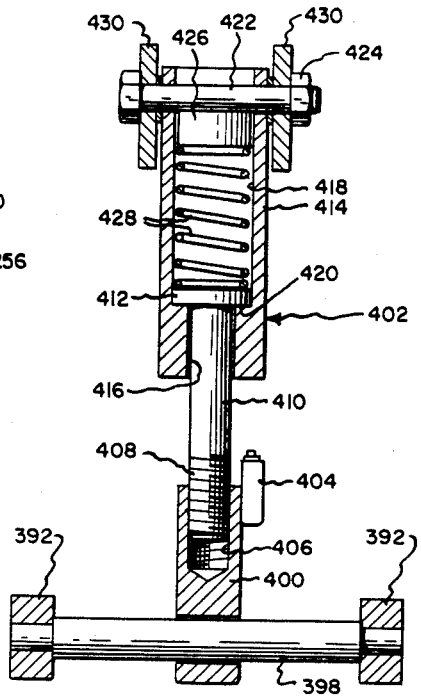
Fig. 10.
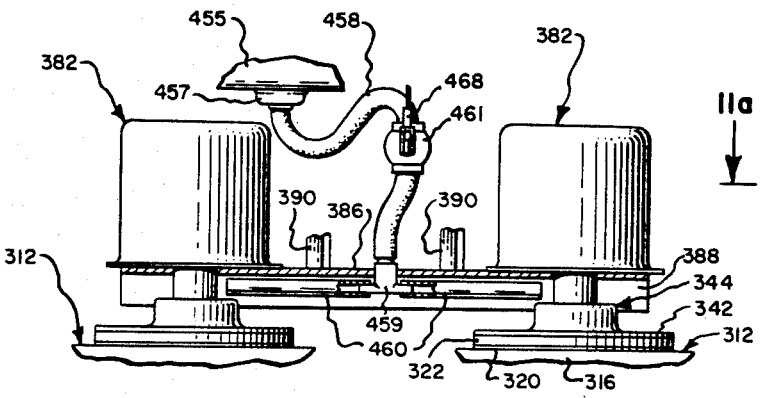
Fig. 11.
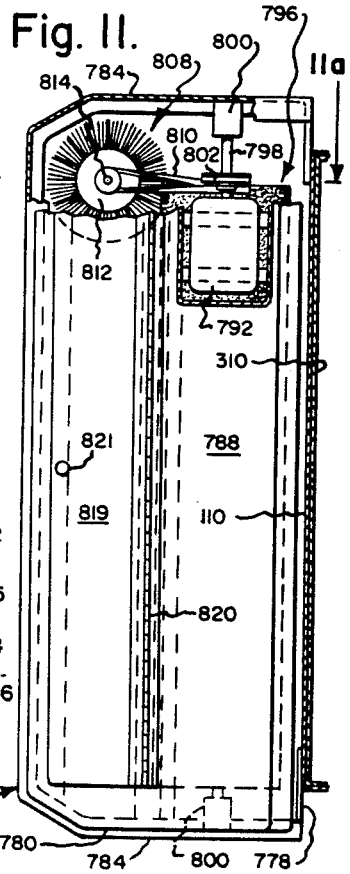
Fig. 16.
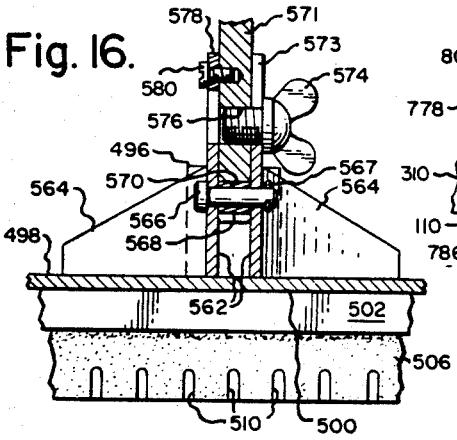
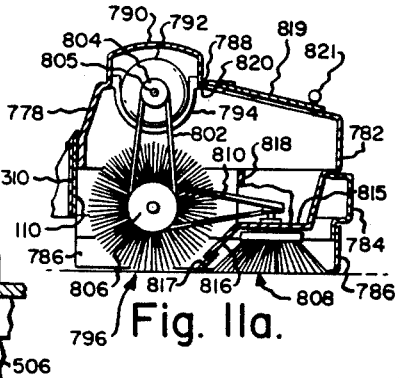
Fig. 11a.

FLOOR CLEANING MACHINE

CROSS REFERENCE TO RELATED APPLICATIONS

This application is a divisional of U.S. application Ser. No. 186,420 filed Sept. 12, 1980, now U.S. Pat. No. 4,380,844, issued Apr. 26, 1983.

BACKGROUND OF THE INVENTION

1. Field of the Invention

This invention relates to surface maintenance apparatus, and more particularly to a new and improved automatic floor cleaning machine expecially adapted for wet scrubbing and vacuum drying of dirty floor surfaces.

2. Prior Art

Generally speaking, known scrubbing and vacuum drying machines usually include a liquid detergent dispenser, wet scrubbers, and a vacuum or suction device for removing the dirty liquid. Normally, whether manually or self-propelled, the transporting wheels and/or casters are located between the leading scrubbers and the trailing vacuum device. This causes problems, because the wheels and/or casters track on the slippery wet surface, making maneuvering difficult and if the vacuum device does not completely cover the wheel tracks, which often occurs on turning, the surface is not properly cleaned. Further, where the machine is of the walk-behind type, such wet slippery areas are hazardous to the operator.

In order to overcome these problems, a variety of approaches have been taken, including complicated and expensive linkages between the vacuum device and the machine frame to ensure proper coverage of the wheel tracks, and elimination of the walk-behind operation in favor of a seated operator. For example, one approach involves a separate forward propulsion unit and a trailing combined scrubber and vacuum unit, so that the transport wheels lead and thus track on a dry surface. While this approach is more effective in cleaning, the cumbersome tandem units are not readily maneuverable, and are only suitable for very large and relatively unobstructed floor areas, besides being difficult and expensive to manufacture, operate and maintain.

Even in the more recent, self-propelled floor cleaning machines of the walk-behind type, difficulty still is encountered in obtaining proper tracking of the suction device to cover the dirty wheel tracks. Likewise, problems, still occur in maneuverability, especially in backing up, because in at least one such machine, the steering handle means is incapable of turning the device while in reverse.

Furthermore, in most instances, the prior art floor cleaning machines make no provision for sweeping up a debris-laden surface prior to wet scrubbing and vacuum drying.

SUMMARY OF THE INVENTION

Accordingly, a primary objective of the present invention is to provide a new and improved automatic floor cleaning machine which overcomes these various prior art problems. To this end, the inventive machine includes a unitary, self-contained and propelled, power driven body means mounting from front to rear in the normal cleaning direction of travel, propulsion means for dry tracking on the floor surface to be cleaned, scrubber means for wetting and cleaning the surface, articulated vacuum means for drying of and proper tracking on the cleaned surface, and control means operatively associated with the propulsion means, scrubber means and vacuum means for controlling actuation of the machine.

Another primary objective is to provide such machine wherein such body means are so constructed and designed as to provide (1) rearwardly extending control housing means for convenient mounting of various components of such control means for ease of actuation; (2) distribution of sufficient weight forwardly of such propulsion means for cantilever suspension of such scrubber means and vacuum means to produce stability and ease of maneuverability, and (3) movable cover means for ready access to components contained therein.

A further primary objective is to provide such machine wherein such propulsion means and/or control means operatively associated therewith are so constructed and designed as to provide (1) control of starting, stopping, speed and direction of travel, and turning in either direction of travel for ease of of maneuverability, (2) manually operated mechanical parking and/or service brake means operable jointly with the turning means; (3) dynamic brake means for quick stopping overcoming momentum, (4) plugging means for a smooth transition of movement upon sudden reversal of travel direction, and (5) deactuation and reactuation of such propulsion means under inadequate power supply conditions for maneuverability even under such conditions.

An additional primary objective is to provide such machine wherein such scrubber means and/or control means operatively associated therewith are so constructed and designed as to provide (1) control of detergent storage and dispensing; (2) driving and vertical articulation of such scrubber means for controlling floor scrubbing pressure; (3) quick release and floating mounting of such scrubber brush means to facilitate removal and replacement and conformance to the floor surface respectively, and (4) deactuation of such scrubber means under inadequate power supply conditions.

Still another primary objective is to provide such machine wherein such vacuum means and/or control means operatively associated therewith are so constructed and designed as to provide (1) control of actuation of such vacuum means, even under inadequate power supply conditions, dirty liquid storage and disposal; (2) control of vertical and horizontal articulation of such vacuum means for drying of and proper tracking on the cleaned floor surface, for compensating for surface irregularities and for adjustment of floor wiping pressure, and (3) quick release mounting of such vacuum squeegee means to facilitate removal and replacement, as well as compensate for wear thereof.

A still further primary objective is to provide such machine preferably with sweeper means mounted on such body means forwardly of such propulsion means in such normal cleaning direction of travel for advance sweeping of a debris-laden floor surface, and wherein such sweeper means and/or control means operatively associated therewith are so constructed and designed as to provide (1) control of actuation of such sweeper means; (2) hopper means for storage of the removed debris (3) main sweeper brush means for feeding debris to such hopper means and side brush means for feeding debris to such main brush means, and (4) deactuation of such sweeper means under inadequate power supply conditions.

Yet another primary objective is to provide such machine wherein such control means are so constructed and designed as to be manually actuated by a walk-behind operator.

Additional objectives and advantages of the invention will become apparent upon consideration of the following detailed description and accompanying drawings, wherein:

BRIEF DESCRIPTION OF THE DRAWINGS

FIG. 5 is an enlarged horizontal longitudinal section taken substantially along line 5—5 of FIG. 2 to illustrate from right to left the steering, stopping and propulsion handle means, the service or parking brake lever, and the detergent dispensing valve control lever, together with their associated elements in the control housing;

FIG. 6 is a vertical longitudinal section taken substantially along line 6—6 of FIG. 5 to show further details of the components illustrated in FIG. 5;

FIG. 7 is a fragmentary vertical longitudinal section taken substantially along line 7—7 of FIG. 5 and depicting the service or parking brake lever in disengaged position in solid lines and in the applied and locked positions in phantom;

FIG. 8 is an enlarged fragmentary vertical longitudinal section taken substantially along line 8—8 of FIG. 3 to show the service brake mechanism actuated by the parking brake lever and by the steering handle means of FIGS. 5 and 6;

FIG. 9 is an enlarged vertical transverse section taken substantially along line 9—9 of FIG. 2 to show parts of the actuator mechanism for vertically articulating the scrubber;

FIG. 10 is a vertical transverse section taken substantially along line 10—10 of FIG. 3 and depicting the dual scrubber brush drive motors and detergent dispensing device;

FIG. 11 is a top plan view taken substantially along line 11—11 of FIG. 1 to show details of the advance sweeper mechanism with part of the cover removed to show the motor driving both brushes;

FIG. 11*a* is a vertical longitudinal section taken substantially along line 11*a*—11*a* of FIG. 11 to show further details of the sweeper motor brush drives and debris storage;

FIG. 16 is enlarged vertical transverse section taken substantially along line 16—16 of FIG. 2 and showing the quick release mechanism for removing and replacing the lower squeegee sub-assembly of the vacuum means as well as vernier adjustment thereof to compensate for wear.

DESCRIPTION OF THE PREFERRED EMBODIMENT

Introduction

Figure 1:
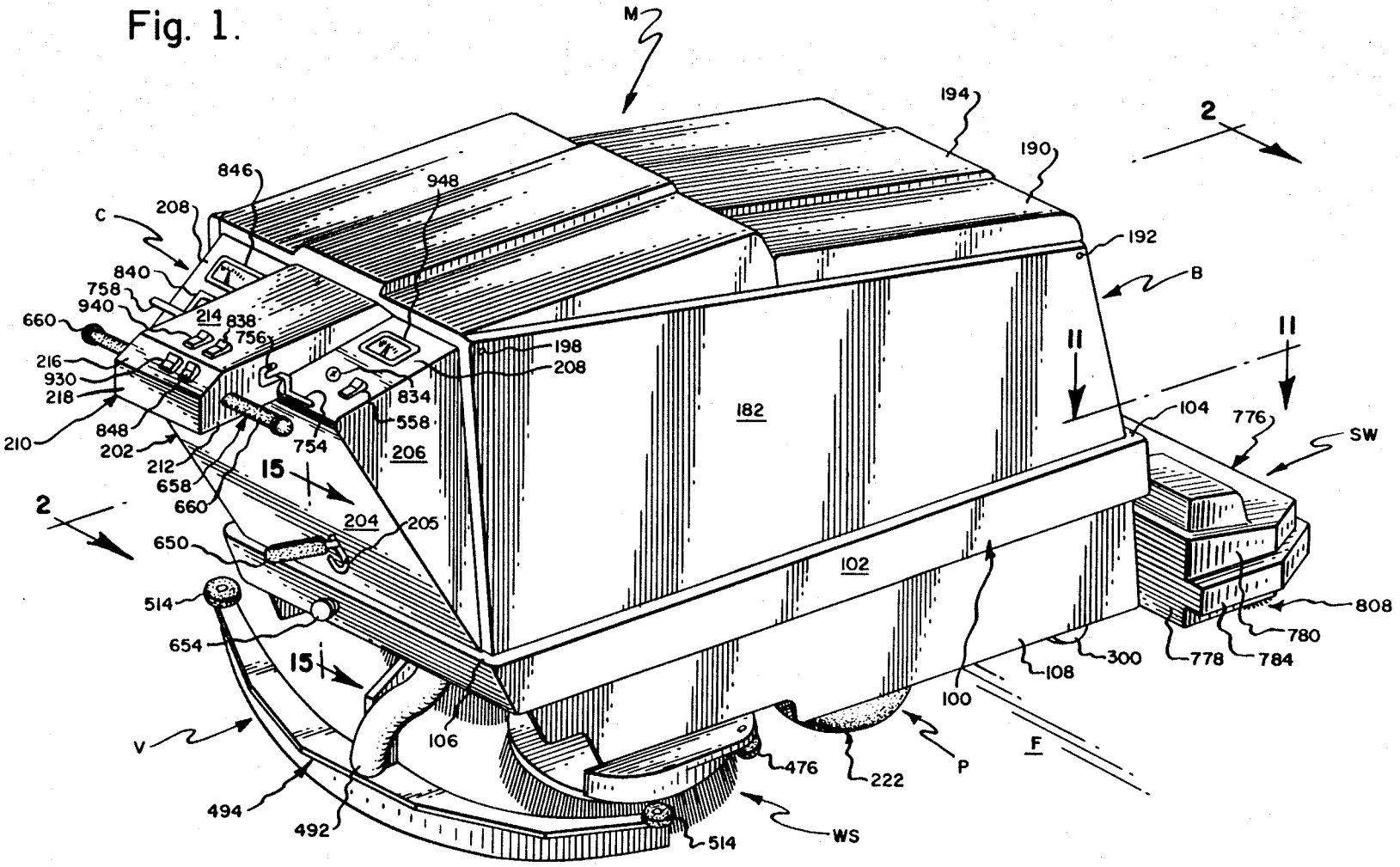
FIG. 1 is a right rear perspective view of an automatic floor cleaning machine constituting a preferred embodiment of the invention, and illustrating the body means mounting from right to left, the advance sweeper means, leading drive wheel means, intermediate scrubber brush means and trailing articulated vacuum means.

Referring to the drawings, wherein like numerals and letters indicate like parts, and particularly to FIG. 1, a preferred embodiment of the inventive automatic floor cleaning machine is generally indicated at M. This includes a unitary, self-contained and propelled, power driven body B mounting from front to rear (right to left) in the normal cleaning direction of travel (left to right) the following components: propulsion mechanism or system P for dry tracking on the floor surface F to be cleaned, scrubber mechanism or system WS for wetting and cleaning the floor surface, vacuum mechanism or system V for drying of and proper tracking on the cleaned surface, and control mechanism or system C operatively associated with propulsion system P, scrubber mechanism WS and vacuum system V for controlling actuation of machine M. Preferably, the machine also includes sweeper mechanism or system SW mounted on body B forwardly of propulsion mechanism P in such normal cleaning direction of travel for advance sweeping of a debris-laden floor surface, with control system C also being operatively associated with sweeper mechanism SW for controlling actuation thereof. While machine M is operable with or without sweeper mechanism SW, inclusion of the latter is preferred, because under normal circumstances, floor surfaces to be cleaned normally have some debris which should be removed prior to the wet scrubbing and drying operation. Hence, such preliminary sweeping operation is most conveniently performed first in sequence by sweeper mechanism SW of machine M.

Unless otherwise obvious or specified, the various structural components of machine M are to be considered as made of suitable material such as metal and, where appropriate, to be suitably secured together or in place, as by welding or the like.

Body

Figure 2:
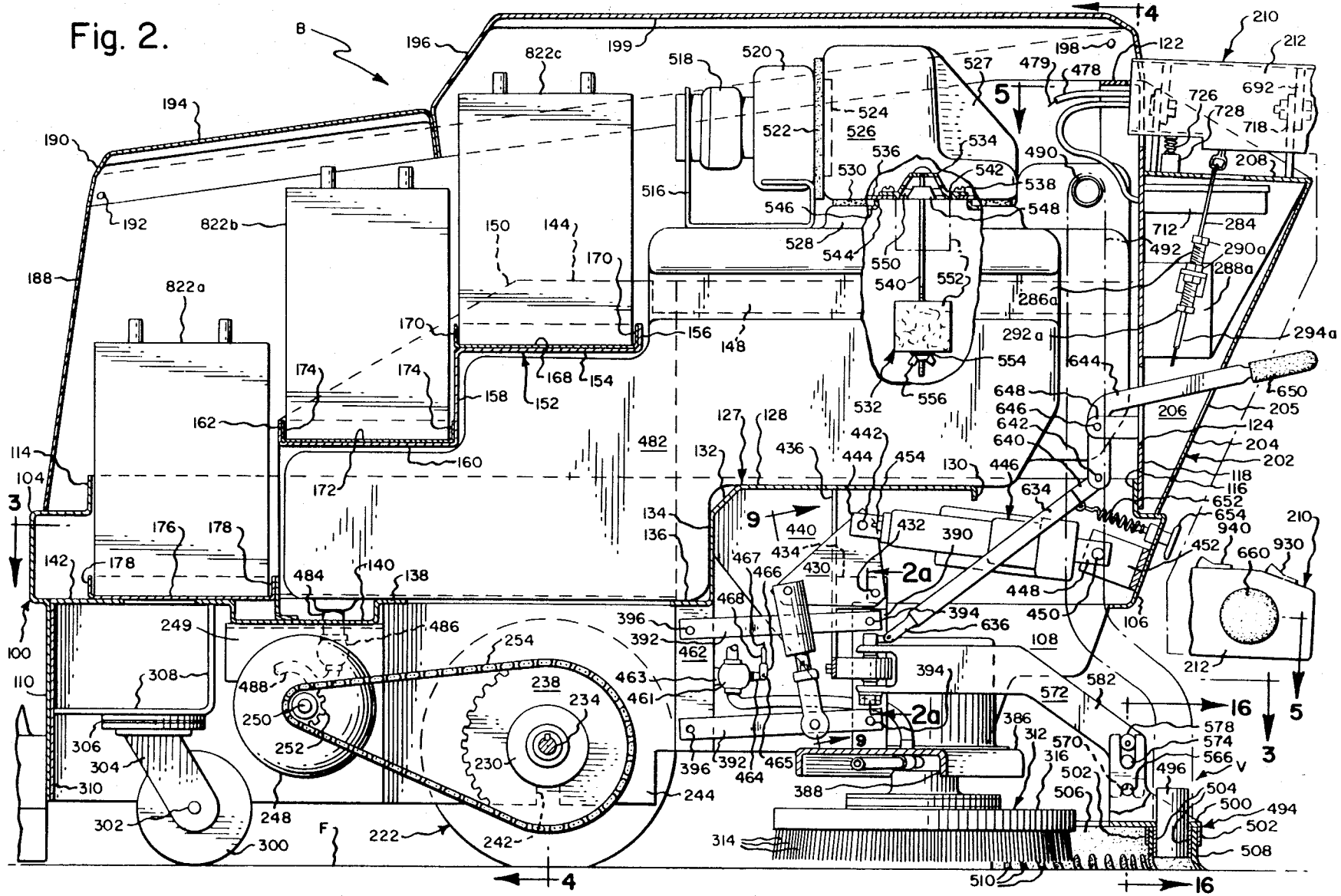
FIG. 2 is an enlarged partial vertical longitudinal section taken substantially along line 2—2 of FIG. 1 to illustrate various components including, inter alia, the stepped D.C. batteries, liquid reservoir systems, propulsion drive wheel means, and scrubber mechanism.
Figure 3:
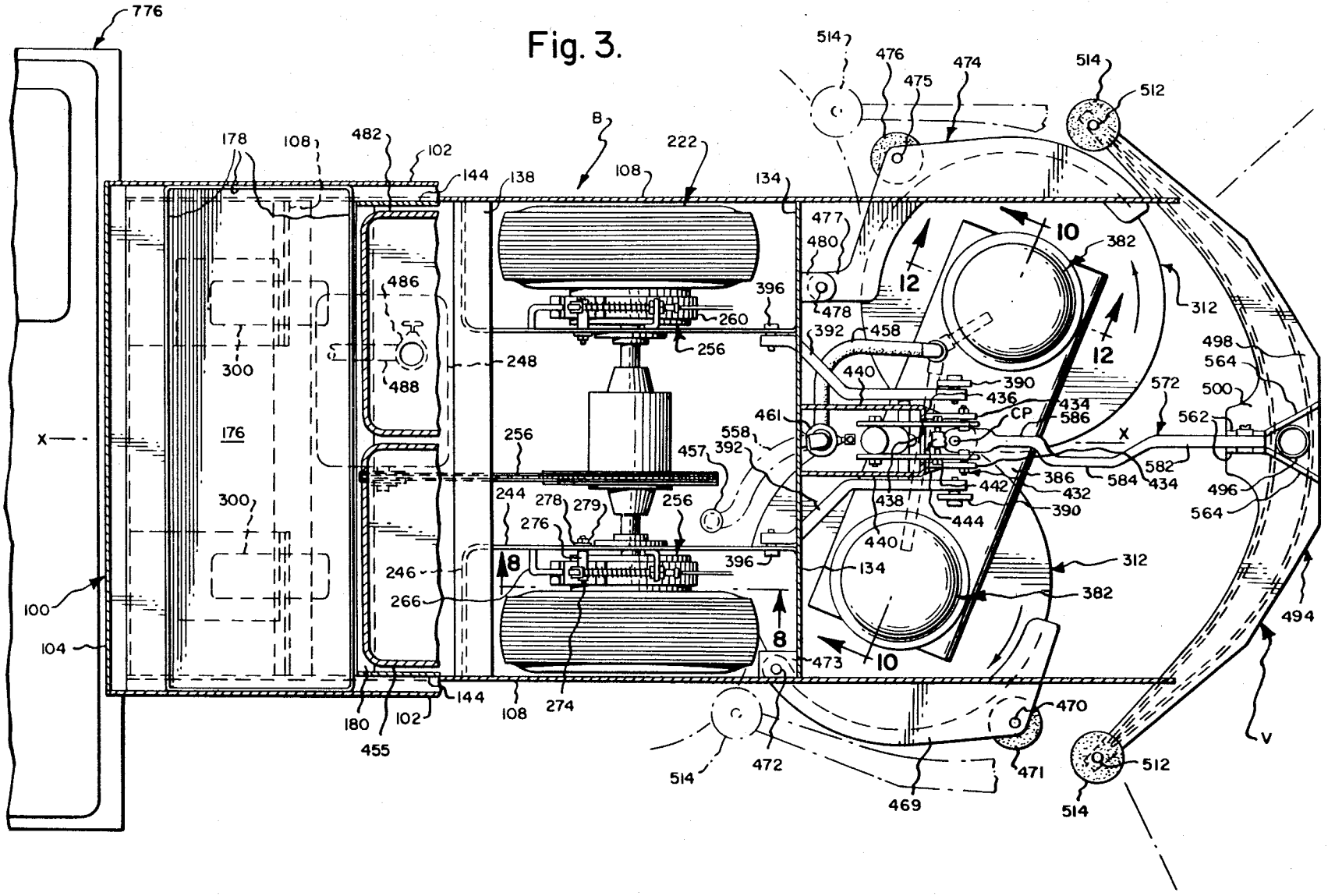
FIG. 3 is a horizontal longitudinal section taken substantially along line 3—3 of FIG. 2, with portions being broken away for clarity and illustrating, from left to right, part of the sweeper mechanism, leading drive wheel means, intermediate dual offset scrubber brush means, and the trailing vacuum means in aligned tracking position during straight line travel, the articulated offset positions thereof during turns being shown in phantom.
Figure 4:
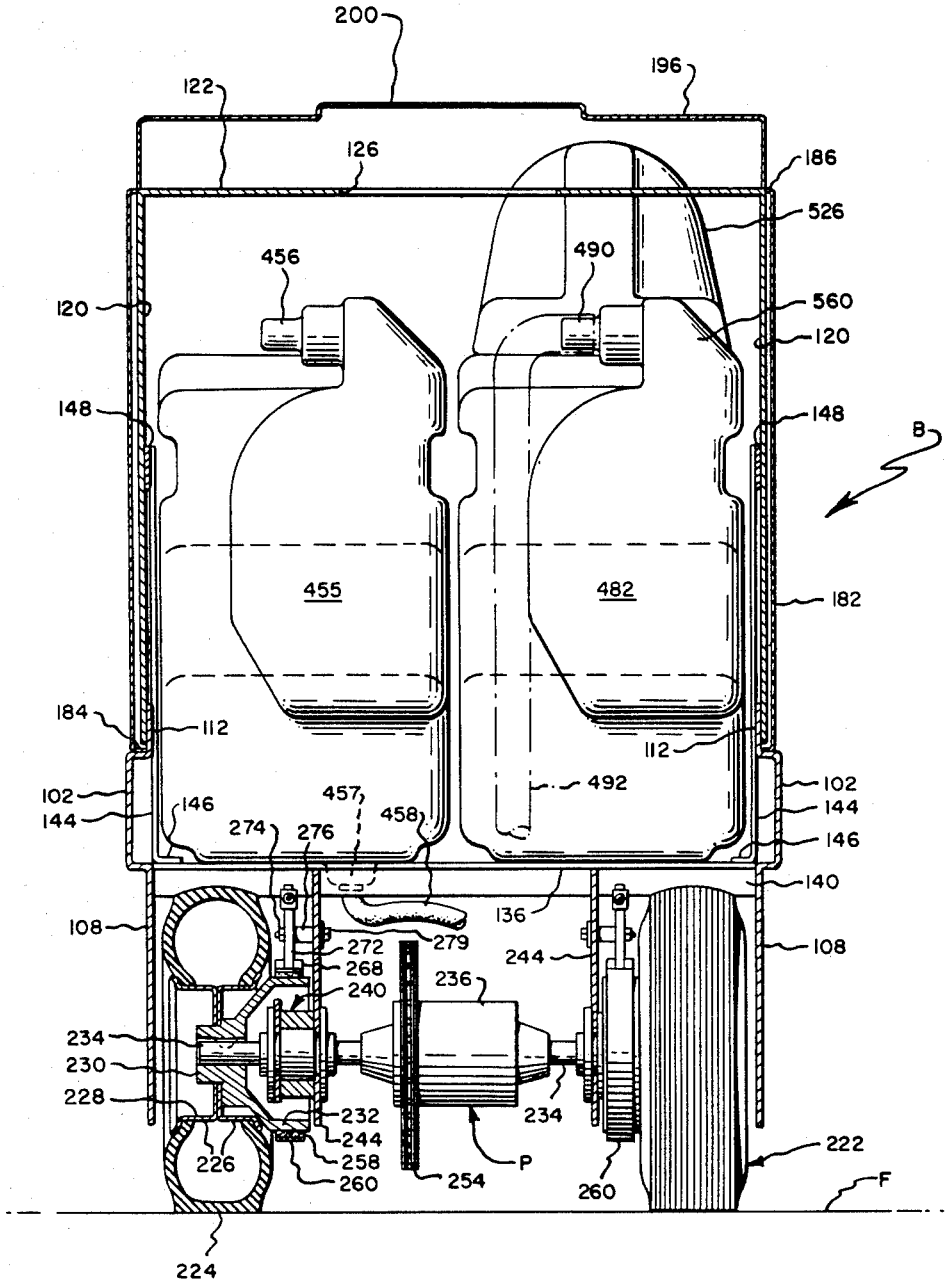
FIG. 4 is a vertical transverse section taken substantially along line 4—4 of FIG. 2 to illustrate the side by side detergent and dirty liquid tanks and the wheel drive means; the left one of which is broken away in section to show details thereof.

As also illustrated in FIGS. 2, 3 and 4, machine body B includes an elongated rectangular frame 100 formed by side channels 102 and front and rear channels 104 and 106 respectively. The side and front channels respectively are provided with inset and downwardly depending side flanges 108 and front flange 110 which act as a splash guard, as well as inset and upwardly extending side flanges 112 and front flange 114, with rear channel 106 being provided with an inset and upwardly extending upper rear flange 116. Suitably secured to the outside of flange 116 is an upstanding rear wall 118 having forwardly extending side flanges 120 embracing the rear end portions of upstanding side flanges 112 on each side of the body, as well as a forwardly extending top flange 122. Rear wall 118 also is provided adjacent its lower central portion with a cut-out 124 and in its upper central portion with a cut-out 126 also extending into top flange 122, both for passage of components to be described below.

Continuing with FIG. 2, body frame 100 is at least partially closed by a stepped lower floor structure generally indicated at 127, and this includes an upper rear floor section 128 having a depending rear flange portion 130 and connected at its forward end by a downwardly inclined upper flange portion 132 with a substantially vertical riser portion 134, terminating at its lower end in a forwardly extending lower step portion 136. Floor 127 also includes an intermediate lower floor section 138 having a central fore and aft recessed portion 140, with floor 127 being completed by a front lower floor section 142, with these various floor sections spanning and being suitably secured to the insides of side flanges 108.

Continuing with FIGS. 2 and 4, body B also is shown as including inner side walls 144 having lower inwardly extending flange portions 146 suitably supported on floor surfaces 138, 136, and connected at their upper rear ends by elongated strips or straps 148 suitably secured to the outer surfaces of wall portions 144 and the inside surfaces of side flanges 120 of rear wall 118, with the front ends of wall portions 144 being tapered downwardly and forwardly at 150. Suitably secured to and spanning wall portions 144 is an upper stepped floor structure generally indicated at 152 and including a rear upper step section 154 terminating at its rear end in an upstanding flange 156 and at its front end in a vertical riser 158 connected to a lower step section 160 terminating at its forward end in an upstanding flange 162.

Suitably mounted on rear upper step 154 is an upper rear battery supporting tray 168 having an upstanding peripheral retaining flange 170, with intermediate battery supporting tray 172 being supported on front lower step section of upper floor structure 152 and having an upstanding peripheral retaining flange 174. Likewise, a lowermost battery supporting tray 176 is supported on intermediate and front lower floor sections 138, 142, and is provided with an upstanding peripheral retaining flange 178.

Thus, the lower end and upper floor structures 127 and 152 cooperate to form stepped supports for the various batteries constituting the power source to be described in greater detail below. Also, reinforcing cross angle 180 is provided with its rearwardly extending lower flange portion suitably secured to the upper surface of recessed portion 140 of intermediate lower floor section 138, while its upper leg is suitably secured to rear flange 178 of battery tray 176, with the ends of angle 180 being suitably secured to side channels 102.

As best seen in FIGS. 1 and 4, body B includes outer side walls 182 terminating in lower and upper inwardly extending flanges 184 and 186 respectively. As shown in FIG. 2, these walls are suitably connected to a slightly rearwardly inclined upstanding front wall 188, which is secured at its lower end to front channel frame member 104, thereby completing the bottom, rear, sides and front wall structure of body B.

As also shown in FIGS. 1, 2 and 4, body B is provided with two movable upper wall or roof sections to facilitate access to the components contained within the body. The front roof or hood section is generally indicated at 190 and is of inverted dish-shaped cross section (FIG. 2), with such front hood section being pivoted at 192 to body side walls 182 and provided with a central longitudinally extending boss 194 for streamlining effect. Likewise, the rear top, roof or hood section 196 is pivoted to body side walls 182 at 198 and also is provided with a central longitudinally extending boss 200 for providing the desired streamlining effect. As will be evident from FIGS. 1 and 2, the two top sections readily can be pivoted so as to provide ready access to the components contained within body B. As will be explained in greater detail below, the lower and upper stepped floor sections 127, 152 cooperate to provide appropriate distribution of weight with respect to propulsion system P, to properly balance scrubber mechanism WS and vacuum system V of machine M by a cantilever effect.

The body also includes, as a rear extension, the housing 202 of control system C, with such housing being of hollow generally triangular cross section and composed of downwardly and forwardly inclined rear wall 204 provided with a central J-shaped slot 205 (for a purpose to be described below) and connected by triangular side walls 206 and spaced rectangular top walls 208 to rear body wall 118. Arranged between space top walls 208 is a raised, central movable section 210 composed of side walls 212, top wall 214, a rear wall including an upper and downwardly rearwardly inclined portion 216 and a lower upstanding portion 218. The bottom of central section 210 is only partially closed at its rear end by a bottom wall 220 (FIG. 6).

Propulsion System

Returning to FIGS. 1–4, propulsion system or mechanism P includes dual motor driven wheel mechanisms generally indicated at 222, with each being composed of a tire 224 suitably mounted on inner and outer rims 226, 228 (FIG. 4) which, are in turn, mounted on a hollow hub 230 forming at its inner end an enlarged brake drum 232. A stub shaft 234 is keyed within hub 230 and is driven by central trans-axle 236 provided with a driven gear 238. Each stub shaft is mounted in a bearing 240 suitably secured within a downwardly open slot 242 in longitudinal wall member 244 suitably secured to lower floor flanges 136, 138, with wall member 244 terminating at its forward end in an outwardly extending flange 246 to form a wheel well.

A reversible motor 248 (FIG. 2) is suitably suspended by a longitudinal channel 249 from the bottom side of recessed portion 140 of intermediate lower floor section 138, with the motor having an output shaft 250 carrying a drive gear 252 connected by a chain drive 254 to driven gear 238. The operation of motor 248 will be described below in connection with FIG. 17, but generally is reversible for driving trans-axle 236 and wheel mechanisms 222 in both forward and reverse directions.

The braking function of propulsion system P is performed by dual brake mechanisms generally indicated at 256, one for each wheel on each side of the central longitudinal axis of machine M. Inasmuch as each brake mechanism is identical, except for positioning, only the detailed structure of left brake mechanism 256 is illustrated in FIG. 8, as including a lining 258 suitably mounted within a shoe 260 having a lower split end 262 hooked over a pin 264 protruding from an L-shaped arm or bracket 266 suitably secured to the outside surface of adjacent wheel well forming wall portion 244. At its upper end, shoe 260 likewise is provided with a split hook 268 secured over a transverse through pin 270 mounted on the lower end of arm 272 pivoted on pin 274. As seen in FIG. 3, this pin 274 is elongated and threaded at opposite ends, as well as provided with a collar 276 for spacing arm 272 away from wall portion 244, with the components being held in place by an outer nut 277 and an inner nut and washer pair 278, 279 threaded in place over the inner end of pin 274 which projects through wall portion 244.

Returning to FIG. 8, at its upper end, arm 272 is provided with a pivot pin 280 for mounting yoke 282 on each side of the upper end of the arm, and suitably secured to the base of yoke 282 is the forward end of a tension cable 284 passing through an externally threaded sleeve 286, which also extends through an outstanding lug on L-shaped flange 288 suitably secured to wall portion 244. The position of sleeve 286 is adjustably fixed by nuts 290 on either side of the lug of flange 288, with the outer or right end of threaded sleeve 286 being removably attached by coupling 292 to cable sheath 294. A washer 296 is provided adjacent the inner or left nut 290 and acts as a stop for spring 298, which is compressed between the base of yoke 282 and the washher to maintain cable 284 under tension. As will be evident, the spring tends to open or loosen shoe 260, and in the position of FIG. 8, the brake is disengaged. When cable 284 is moved to the right in FIG. 8, spring 298 is compressed, while arm 272 pivots clockwise about pin 274 to close or tighten shoe 260 and thus engage the brake, as will be described in greater detail below.

Returning to FIGS. 2 and 3, propulsion system or mechanism P is completed by a pair of guide wheels or casters 300 suitably rotatable on axles 302 spanning mounting yokes 304, one on each side of the central longitudinal axis of machine M. Each yoke 304 is, in turn, rotatably mounted by a bearing 306 on a J- or L-shaped angle member 308 suitably secured at its upper and front ends to the forward end of intermediate lower floor section 138 and an inner front wall member 310 which forms reinforcement of inset depending wall flange 110.

Wet Scrubber System

The scrubber system or mechanism WS is best shown in FIGS. 2–4, 10 and 12–14, and includes a pair of brushes generally indicated at 312, the left one of which (FIG. 3) is positioned forwardly of the right one, but otherwise the construction of each is identical. Hence, a detailed description of one is equally applicable to the other.

Figure 12:
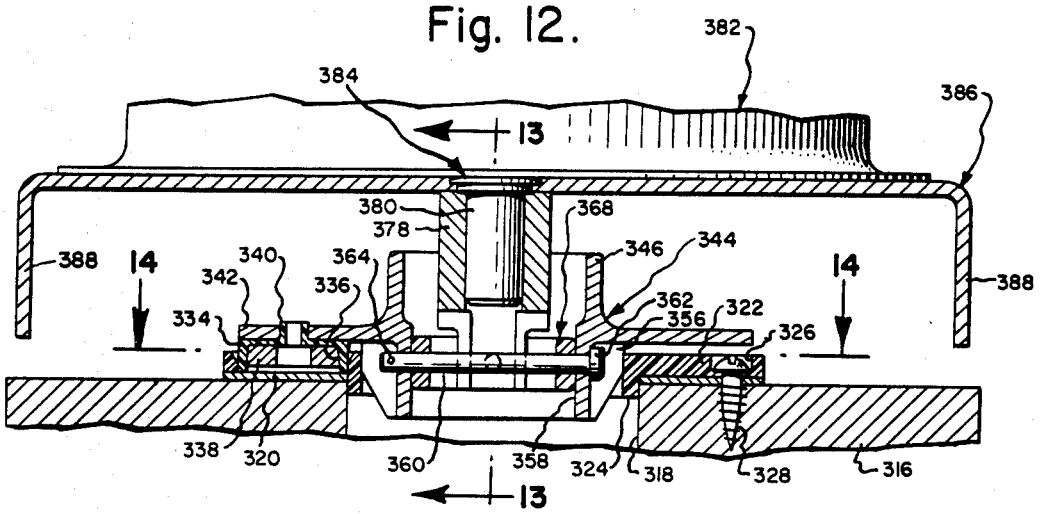
FIG. 12 is an enlarged partial section taken substantially along line 12—12 of FIG. 3 and illustrating one of the two floating gimbal-like and quick release magnetic mountings for the scrubber brushes.
Figure 13:
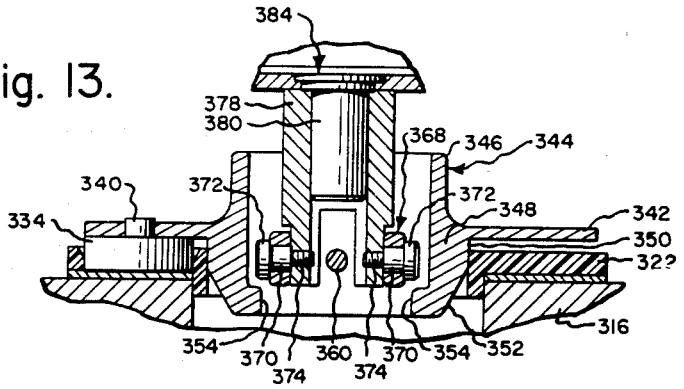
FIG. 13 is a fragmentary section taken substantially along line 13—13 of FIG. 12.
Figure 14:
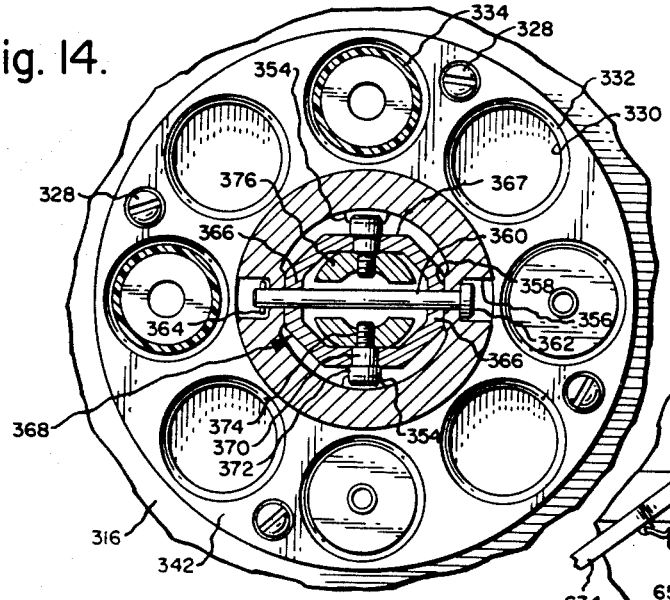
FIG. 14 is a partial section taken substantially along line 14—14 of FIG. 12.

Each brush 312 includes bristles 314 embedded in and depending from a circular backing 316 made of suitable material such as wood or plastic. As seen in FIGS. 12–14, each backing 316 is provided with a central through opening or hole 318, and mounted on the upper surface of the backing is an annular metal base plate 320 topped by an annular insulating plate 322 having a depending inner rim portion 324 fitting within opening 318, as well as a plurality of circumferentially spaced, countersunk recesses 326 for the reception of screws 328 passing thru metallic plate 320 and threaded into backing 316 to hold both plates in place. In addition, insulating plate 322 is provided with a plurality of large circular through cavities 330 having tapered upper entrances 332 for the reception of insulated magnet holders 334 of inverted cup-shaped cross section, the inner walls 336 of which form conically tapered openings for the reception of similarly tapered annular magnets 338 wedged in place. The upper surface of each magnet holder 334 is provided with a central upstanding hollow boss 340 passing upwardly through and secured in the horizontal flange 342 of an annular outer mounting member 344.

This member is provided with an upstanding central hub portion 346 and a thickened lower hub portion 348, the vertical upper outer peripheral portion 350 of which terminates in a downwardly and inwardly tapered lower peripheral portion 352 having diametrically opposed and inwardly extending detents or shoulders 354 (FIG. 13) arranged perpendicularly to a diametrically opposite pair of outwardly opened recesses 356 (FIG. 14) aligned with inset opposed flats 358, and through which passes an axle or pivot pin 360 having a head 362 seated in one recess 356 and a pin 364 securing the other end of axle 360 in place in the opposite recess 358. Pin 360 also passes through a pair of diametrically opposite sections 366 of a hollow inner mounting member 368 of generally octagonal cross-section. A pair of studs 370 are arranged perpendicularly to pin 360 passing through diametrically opposite sections 367 of inner mounting member 368, with the heads 372 of the studs in spaced overhanging relationship with internal annular shoulder 354, and with their threaded portions 374 engaged through the split arcuate and outwardly flattened lower ends 376 of bushing 378. Within this bushing is fixed the downwardly depending output shaft 380 of electric drive motor 382, with the shaft being mounted in bearing 384 in the upper transversely elongated rectangular web portion of motor mounting member 386 (FIG. 3) having depending front and rear reinforcing flanges 388.

As will be evident, each brush 312 is removably held in place by magnets 338 to facilitate quick removal and replacement upon wear of bristles 314. In addition, the outer and inner mounting members 344, 368, through pivotal pin mountings 360, 370 etc. cooperate to permit each brush 312 to adjust to variations in the surface of the floor to be cleaned, with each outer member 344 and magnetically held brush 312 pivoting not only about the axis of pin 360 to the extent permitted by the space between heads 372 of studs 370 and the upper surface of lower inner shoulder 354 on outer member 344 but also about the common axis of studs 370 to the extent permitted by the space between the upper surface of member 368 and the outer periphery of bushing 378. This produces a gimbal-type mounting action as the brushes rotate with drive shaft 380 and bushing 378. Hence, brushes 312 readily float to compensate for the unevenness of the floor surface during their rotation.

For vertical articulation of brushes 312 relative to floor surface F, the upper rectangular web of the motor mounting member (FIGS. 2 and 3) is provided with a pair of upstanding arms or links 390 arranged between the housings of brush drive motors 382, and adjacent their upper and lower ends, each arm 390 is pivotally mounted to the inset and longitudinally extending rear portions of upper and lower yoke arms or links 392 by means of pivot pins 394. As will be evident from FIG. 2, the front end of each yoke arm is mounted by means of pivot pin 396 to the inside of the adjacent wheel well forming wall 244 adjacent its rear end (FIG. 3). As also seen in FIG. 9, a transverse pin 398 connects the two lower yoke arms 392 intermediate their ends, and pivotally supports the lower end member 400 of an extensible link generally indicated at 402. This lower end member 400 is provided with an upstanding lower limit switch 404 which is normally closed when in the position shown in FIG. 9 and also is internally threaded at 406 to receive the externally threaded lower end 408 of a rod 410 having an enlarged head 412 operatively associated with upper member 414 of link 402. Such upper member is provided with a reduced lower bore 416 for the reception of rod 410 and an enlarged bore 418 slidably receiving head 412, such bore having a lower shoulder 420 capable of supporting the head. At the upper end of link 402 a transverse pivot bolt 422 passes through upper member 414 and is secured in place by nut 424. Within cylinder 418 is a plug 426 which is pressed against the underside of bolt 422 by the upper end of spring 428 engaging at its lower end the upper surface of head 412.

Thus, as brushes 312 come in contact with floor surface F to be cleaned, the pressure exerted by the brush bristles 314 on the surface is controlled by the compression of spring 428, and as the bristles 314 wear, this is automatically compensated for by the downward movement of the bell crank lever structure described below.

Figure 2A:
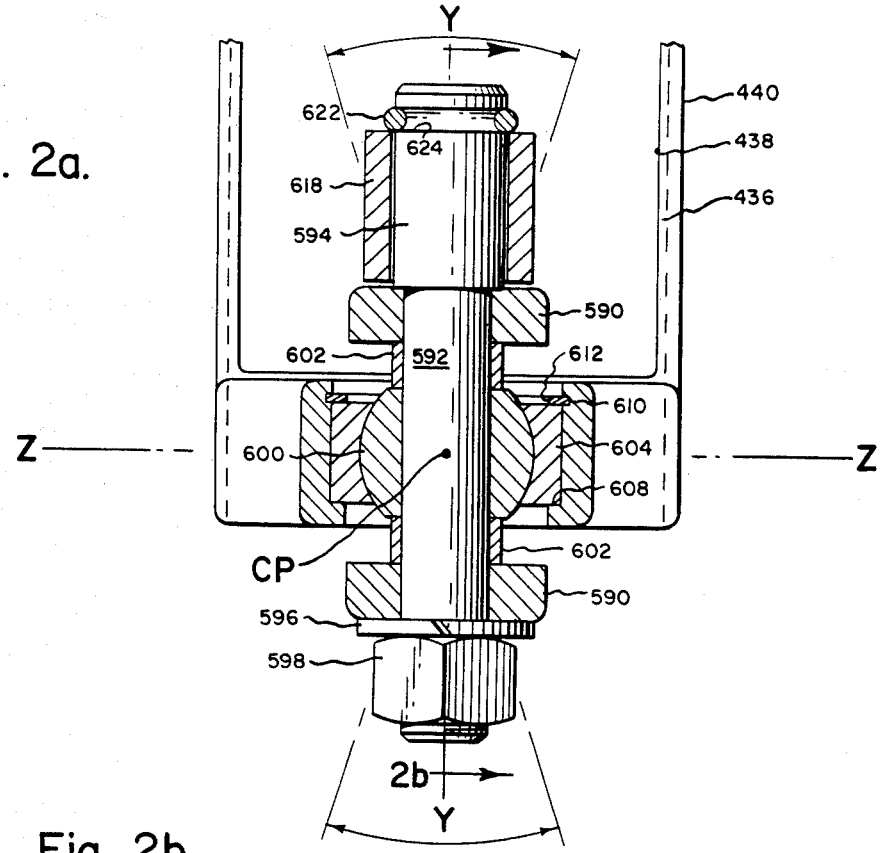
FIG. 2*a* is an enlarged fragmentary vertical transverse cross-section taken substantially along line 2*a*—2*a* of FIG. 2 and showing details of the modified universal joint means mounting of the squeegee arm means and lever-operated linkage means.
Figure 2B:
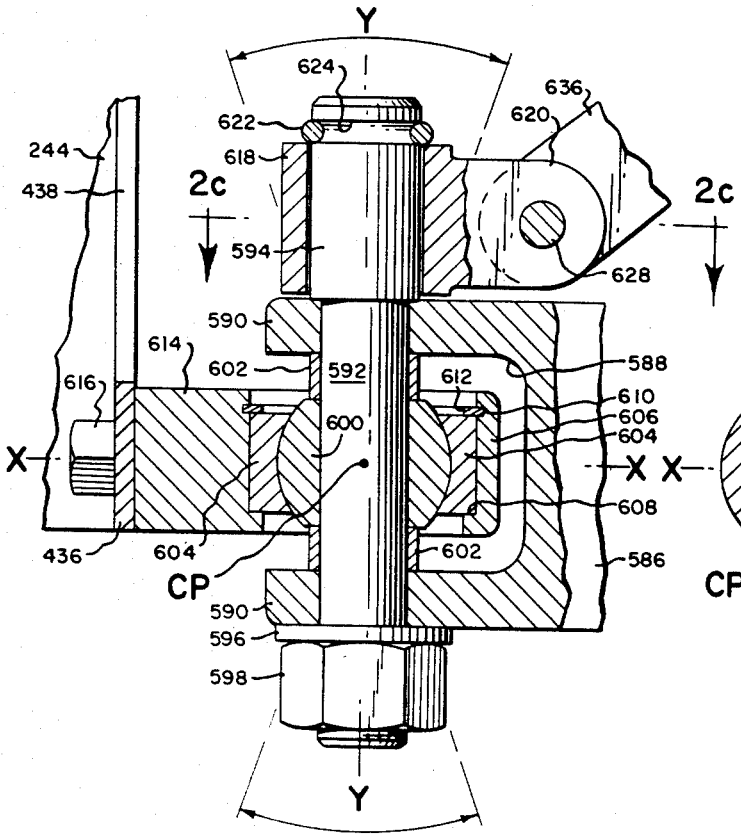
FIG. 2*b* is a fragmentary vertical longitudinal section taken substantially along line 2*b*—2*b* of FIG. 2*a* and showing further details of such mounting.
Figure 2C:
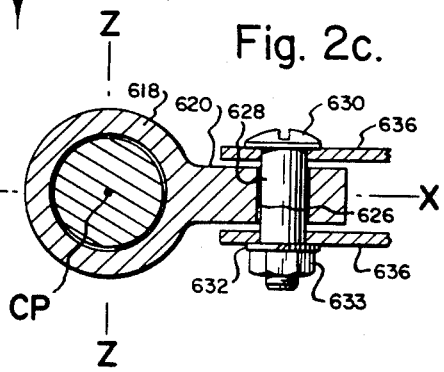
FIG. 2*c* is a fragmentary horizontal transverse section taken substantially along line 2*c*—2*c* of FIG. 2*b* and showing still further details of such mounting.

Continuing with the articulating structure of the scrubber mechanism WS, the upper end of extensible link 402 is pivotally connected to a bell crank lever structure in the form of two spaced triangular plates 430, the lower front ends of which are pivotally mounted on pin 422 (FIG. 9). At their lower rear ends, plates 430 are pivotally connected at 432 to longitudinally and rearwardly extending flanges 434 (FIGS. 2 and 3) suitably secured to a transverse web 436 which is provided with a central through opening 438 (FIG. 2*a*) for the passage of triangular plates 430 and connects longitudinal support walls 440 of generally triangular shape and suitably secured to the adjacent surfaces of upper rear lower floor section 127, specifically outer surfaces of upper section 128 inclined section 132 and riser 134.

At their upper ends, triangular plates 430 are suitably pivotally mounted by pin 442 on each side of the forward end of a piston rod 444 of reciprocal motor 446, the rear end of which is provided with a lug 448 pivotally mounted at 450 between the flanges of a yoke-shaped bracket 452 suitably secured to the inside of rear frame channel member 106. Near the front end of motor 446 there is provided a normally closed upper limit switch 454 engageable by the pivot pin 442 or one of plates 430 upon retraction of piston rod 444, to limit the upper movement of brushes 312 relative to the floor surface Reciprocal motor 446 is of conventional electrical construction and its electrical operation, together with that of upper limit switch 454 and lower limit switch 404 in controlling the extent of vertical articulation of brushes 312 will be described in greater detail below. Mechanically however, extension of piston rod 444 from right to left in FIG. 2 pivots bell crank lever forming plates 430 counter-clockwise, moving extensible link 402 downwardly, thereby pivoting yoke links 392 downwardly to lower brushes 312 toward the floor, with lower limit switch 404 shutting off motor 446 when brushes 312 are in maximum floor scrubbing pressure contact. Just the reverse movement of the various links in the linkage occurs when motor piston rod 444 is retracted until upper limit switch 454 is opened to shut-off motor 446. In FIG. 2, the brushes 312 are shown in retracted position.

The wet scrubber mechanism or system WS is completed by the following structure which supplies the detergent to the brushes. As best seen in FIG. 4, a hollow detergent tank 455 is provided, and while it may be made of any suitable material, it preferably is molded from plastic to the stepped shaped illustrated in FIG. 2 for the dirty liquid tank 482 to be described below, for conformance with upper and lower stepped floor structures 152 and 127 respectively, with the tanks being supported on lower floor sections 128, 136 and 138, and with approximately half the capacity of the tanks being positioned generally over and forwardly of propulsion wheels 222 for the desired weight distribution. As also is evident from FIG. 2, the upper and lower floor sections 152 and 127 form with the adjacent walls of body B upper and lower stepped compartments which partially overlap over and forwardly of wheels 222 for the positioning of tanks 455 and 482 aw well as the power source batteries shown. This arrangement provides the desired cantilever suspension of scrubber mechanism WS and vacuum system V to facilitate maneuvering of machine M by the walk-behind operator.

Continuing with FIG. 4, detergent tank 455 is arranged on the left side of body B and is provided with an inlet such as 456 in its upper rear left side portion for the reception of a fill hose (not shown) leading from an external detergent supply resevoir (not shown). At its lower rear bottom portion, tank 455 is provided with an outlet 457 connected by a flexible manifold conduit 458 to a T-shaped manifold 459 (FIG. 10), which, in turn, is connected to oppositely extending conduits 460 terminating adjacent each brush 312. A mechanically operated flow control valve 461 is provided in manifold conduit 458 and is suitably mounted on a channel member 462 (FIG. 2) depending downwardly from horizontal floor section 136 by means lug 463. Valve 461 is provided with a lever 464 pivotally connected at 465 to a yoke 466 having its web connected to a wire or cable 467 encased within a sheath 468 for controlling the operation of valve 461, as will be described in greater detail below.

During machine operation, when brushes 312 are in proper scrubbing contact with floor surface F to be cleaned, flow control valve 461 is opened to permit the detergent to flow by gravity through manifold 458, distributing conduits 460, and down through brushes 312 to provide for the proper wetting and detergent scrubbing action in cleaning the floor surface.

In order to prevent the detergent from splashing too far laterally of brushes 312, two splash guards are provided. As shown in FIG. 3, the left splash guard is indicated at 469 and is arcuately shaped in cross section to conform to the curvature of brush 312. This member is provided adjacent its rear end with a depending pin 470 rotatably mounting a bumper roller 471 for guiding machine M along walls, and at its forward end, splash guard 469 is pivoted at 472 to flange structure 473 suitably secured to the adjacent body structure. A complementary right splash guard 474 is provided adjacent its front end with a depending pin 475 pivotly mounting a bumper roller 476, and at such front end it has a longitudinal leg portion 477 suitably pivoted at 478 to a flange or the like structure 480 suitably secured to the adjacent body structure.

At this point it is to be noted that brushes 312 are mounted in longitudinally staggered relation, with the left brush leading the right brush, and the brushes are mounted so that their adjacent inner peripheries substantially coincide at a common point CP on the longitudinal central axis X—X of machine body B for a purpose to be described below. Also, it is to be noted that brushes 312 rotate in the direction of the arrows, i.e. their inner peripheries counter-rotate rearwardly, with left brush 312 rotating clockwise and right brush 312 rotating counter-clockwise, to direct the dirty liquid centrally and rearwardly longitudinally toward vacuum mechanism V.

Vacuum System

As shown in FIGS. 1–3, the vacuum system or mechanism is generally indicated at V, and includes a molded tank 482 (FIGS. 2 and 4) quite similar to detergent tank 455, as noted above. However, at its lower front end portion, it is provided with a depending dirty water outlet 484 having a mechanically operated shut-off such as valve 486 connected to a drain hose 488 which, during operation, is suitably supported within the body of the machine out of the way. At its upper rear end, on the left hand side, tank 482 is provided with a dirty water inlet 490 connected by means of an inlet conduit or hose 492 to a squeegee mechanism generally indicated at 494 (FIGS. 1–3). This squeegee mechanism, in turn, is provided with an upstanding outlet tube 496 suitably secured within conduit 492, and mounted centrally of a generally crescent-shaped, arcuate housing plate 498 having a forwardly extending central boss portion 500. Plate 498 also is provided with an inner pair of depending flanges 504 and an outer pair of shorter and removable retaining clamps 502 suitably secured to flanges 504 by screws (not shown), for securing between adjacent clamps and flanges the arcuate front and rear squeegee blades 506, 508 respectively, such blades being made of suitable elastomeric material such as rubber or the like. The forward one of these blades 506 is further provided with a series of circumferentially spaced and downwardly open through slots 510 for passage of dirty liquid therethrough into the chamber formed between the two blades. As will be evident from FIG. 3, the depending clamps and flanges 502, 504 and wiper blades 506, 508 are curved so as to provide a crescent-shaped chamber having tapered outer ends and widening toward the center upright outlet tube 496 to direct the dirty liquid rearwardly and transversely inwardly toward such outlet tube. The bottom of tube 496 is spaced above floor surface F far enough to permit picking up debris but close enough to provide proper air velocity depending on fan suction capacity. Likewise, at its distal ends, squeegee plate 498 is provided with upstanding pivot pins 512 rotatably mounting bumper wheels 514 for guiding along adjacent wall surfaces.

Assuming that a vacuum is created, the dirty water being wiped by squeegee 494 is sucked up through outlet tube 496 and conduit 492 through inlet 490 (FIG. 4) into tank 482. For this purpose, a generally L-shaped bracket 516 is suitably mounted on the top wall of tank 482 supporting a motor 518 driving a fan 520 which, by means of seal 522 has its entrance 524 within a generally L-shaped hollow chamber or plenum forming member 526 provided with a central reinforcing gusset or handle 527, and preferably molded to shape from suitable plastic material as used for tank 482. In turn, member 526 is removably mounted on an upstanding hollow boss 528 provided on the top of tank 482, for ease of access to the tank and anti-fouling device described below, with the joint being sealed by an annular gasket 530.

When motor driven fan 520 is operating, a vacuum is developed in the system, so that the dirty liquid is effectively sucked up through conduit 492 from squeegee mechanism 494 into tank 482, as noted above. However, in view of the fact that this liquid is detergent in nature, it has a tendency to foam, and as the tank becomes full, the foam has a tendency to rise and possibly foul the entrance 524 to fan 520. While any suitable anti-fouling device may be employed to prevent this undesirable result, the following mechanism incorporating the teaching of U.S. Pat. No. 3,290,865, preferably is employed for this purpose. Inasmuch as the patented device forms no part of the present invention, only so much of the teaching therein will be referred to herein as is necessary for an understanding of the anti-fouling operation.

To this end, the foam control or anti-fouling device includes a valve generally indicated at 532 (FIG. 2) composed of a molded plastic spider 534 suitably secured on the bottom wall 536 of member at 538 and fixedly supporting a valve rod 540 extending downwardly through opening 542 in bottom wall 536 and opening 544 in the upper wall 546 of hollow boss 528 on tank 482. A plastic disc 548 preferably is molded integrally within spider 534 and connected thereto by circumferentially spaced lugs 550, with the adjacent peripheral portions of the spider and ring being conical in shape to form the desired upwardly converging conical spacing therebetween for the floor of an air stream upwardly into plenum number 526.

Figure 17:
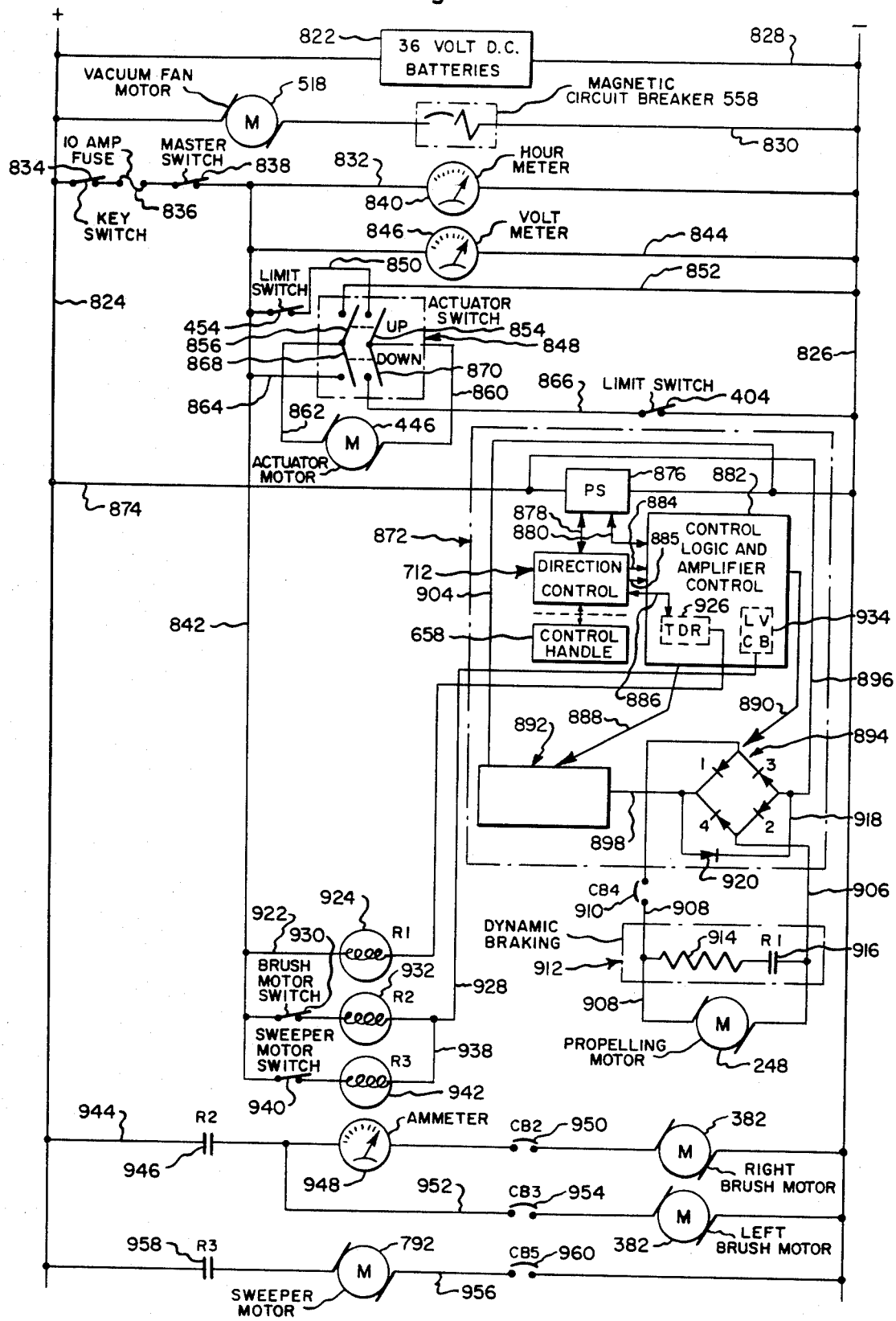
FIG. 17 is a schematic wiring diagram of the electrical circuitry making up the overall electrical control system for operating the inventive machine, including the propulsion, turning, stopping, reversing, sweeping, scrubbing and vacuum functions.

In order to prevent the foam from passing upwardly into chamber 526, a float 552 is slidable on valve rod 538, with its lowermost position being determined by washer 554 and wing-nut 556 suitably secured on the lower end of valve rod 538. Thus, as tank 482 fills and the foam rises, float 552, which is made of very light weight foam rubber or plastic, actually rides on the top of the foam and moves upwardly therewith until the useful foam capacity of the tank is reached, whereupon the float is entrained in the upwardly flowing airstream and quickly pulled up into the dotted line position, sealing tank 482, with the negative pressure in chamber 526 holding float 552 in such upper position. The fan motor 518, which is externally air cooled will continue to run, unless an overload opens on-off vacuum fan overload magnetic circuit breaker 558 (FIG. 17).

If desired, and as disclosed by the aforesaid patent, the washer 554 may be suitably secured to a bracket (not shown), which, in turn, could be part of a wire cage or the like (not shown) arranged within the rear upper portion of tank 482, which also could be provided with a baffle (not shown) for directing the foam around the float.

In order to facilitate removal and replacement, squeegee 494 is provided with a quick attachment and release device, as best shown in FIGS. 2, 3 and 16. This includes a pair of generally L-shaped upstanding arms 562 suitably mounted on plate 498 and provided with rearly diverging feet 564 straddling outlet tube 496. These arms are connected by a transverse pin 566 which is secured in place by a cotter pin 567 and passes through a spacer bushing 568 received in the downwardly open slot 570 in the lower end 571 of articulated mounting arm 572 arranged between arms 562. The upper ends of arms 562 are provided with upwardly open slots 573, with a wing bolt 574 extending through one of the slots and into threaded engagement with threaded opening 576 in lower arm end 571. Engaged in the opposite slot above wing bolt 574 is a disc-shaped cam 578 held in place by set screw 580 threadedly engaged in lower arm end 571. Thus, by loosening wingbolt 574 and cam 578, squeegee 494 is readily removable and replaceable. At the same time, off-center rotational tightening of cam 578 in opposite slot 573 provides adequate fore and aft adjustment of squeegee 494 about the axis of pin 566, so that any slack in the joint is taken up and both wiper blades 506, 508 are properly located in an upright position to make the desired wiping contact with floor surface F to be cleaned.

Articulation of squeegee 494 is accomplished by the structure illustrated in FIGS. 2, *2a*, *2b*, *2c* and 3. The lower end 571 of articulating arm 572 is connected by upwardly and forwardly inclined portion 582 to the front horizontal end portion which includes an offset portion 584 (to clear the housing of right brush motor 382) terminating in a straight front portion 586, which ends in a vertically positioned recess 588 defined by upper and lower yoke arms 590. A rocker axle pin 592, which passes vertically through arms 590 is provided at its upper end with an enlarged head portion 594, and at its lower end with a washer 596 and nut 598. Pin 592 is surrounded by a hollow spherical bearing 600, the opposite ends of which are flattened and spaced from adjacent yoke arms 590 by sleeves 602. Spherical bearing 600 is movable within bearing block 604 which is seated within annular flange 606 provided with internal lower shoulder 608 and an inset annular upper recess 610 for the reception of split locking ring 612 which holds bearing block 604 in place. Annular flange 606 is formed as an extension of lug 614 which is suitably secured by bolts 616 (only one being shown) to the lower portion of web 436 below recess 438 between walls 440.

Continuing with FIGS. *2a*, *b* and *c*, head 594 of rocker axle pin 592 is surrounded by eyelet 618 of horizontally and longitudinally positioned pivot arm 620, with eyelet 618 being held in place by split ring 622 engaged in annular recess 624. Pivot arm 620 is provided at its rear end with a horizontal and transverse through opening 626 for the reception of bolt 628 held in place by its head 630, washer 632 and nut 633. Bolt 628 also passes through a pair of yoke arms 636 spanning pivot arm 620 and these yoke arms form the lower front end of an upwardly and rearwardly inclined link 634 terminating at its rear end in yoke arms 640 (only one being shown) spanning and connected by pivot pin 642 to the lower vertical end of bell crank lever 644, which lower end likewise is pivoted at 646 to yoke arms 648 suitably secured to rear body wall 118 on either side of cutout 124. The rear upwardly inclined end of bell crank lever 644 passes through cutout 124 and J-shaped slot 205 in the control housing wall 204, with its reduced outer end portion being covered by a handle grip 650 for manual actuation by an operator.

Figure 15:
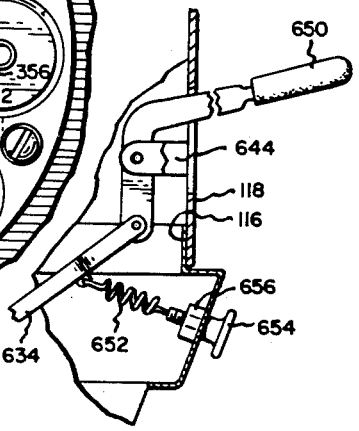
FIG. 15 is an enlarged fragmentary vertical longitudinal section taken substantially along line 15—15 of FIG. 1 to depict parts of the manually operated lever mechanism for vertically articularing and adjusting the wiping pressure of the vacuum squeegee means shown in FIGS. 2 and 3.

Squeegee 494 and its mounting arm 572 are normally biased downwardly into the operative position by a spring 652 (FIGS. 2 and 15) suitably secured at its forward end to link 634 adjacent its upper end, and at its rear end to a knob screw 654 adjustable in fixed nut 656 secured to the inside of rear frame member 452. In the position shown in FIGS. 1, 2 and 15, squeegee 494 is in operative wiping contact with floor surface F to be cleaned. However, by depression of handle grip 650, the operator readily can move squeegee 494 vertically out of such operative position and lock such squeegee in elevated inoperative position by moving bell crank lever 644 into engagement with the lower hook end of J-shaped slot 205.

Assuming that vacuum system V is in operation, with squeegee 494 in the operative position illustrated, the special universal type mounting of the front end 586 of squeegee arm 572 permits the desired articulation of squeegee 494 about three axes, the first being a vertical axis through axle pin 592, thereby permitting squeegee 494 to swing from left to right, as machine M turns. For example, should machine M make a U-turn to the left, squeegee 494 will move to the lower dotted line position shown in FIG. 3 to properly track behind brushes 312 and thereby dry the floor surface being scrubbed. Alternatively, should machine M make a U-turn to the right, squeegee 494 will assume the position shown in dotted lines at the top of FIG. 3 for such proper tracking.

At the same time, rocker axle pin 592, by virtue of movement of spherical bearing 600 in bearing block 604 is free to rock fore and aft about a transverse horizontal axis through pin 592 and sperical bearing 600 as shown by the arrows in FIG. *2b*, while simultaneously being free to rock about a central longitudinal horizontal axis through bearing 600 and block 604 from side to side, as shown by the arrows in FIG. *2a*. As a consequence, this simultaneous articulation, including swinging movement of squeegee 494 and arm 572 from side to side combined with rocking movement fore and aft and transversely, insures not only proper tracking action, but also compensates for irregularities in floor surface F to be cleaned.

The vertical swinging axis is indicated at Y—Y in FIGS. *2a* and *2b*, with the horizontal fore and aft rocking axis being indicated at Z—Z in FIGS. *2a* and *2c*, while the horizontal transverse rocking axis is indicated at X—X in FIGS. *2b* and *2c*. This last axis constitutes the central longitudinal axis of machine body B, noted previously. Moreover, these three axes intersect at a common point CP (FIGS. *2a*, *b* and *c*) which, as shown in FIG. 3, is located on a common radial line connecting the axes of rotation of brushes 312 between the adjacent rearwardly moving peripheral portions thereof. As a consequence, squeegee 494 is mounted closely adjacent brushes 312 for the desired proper tracking and drying functions.

Control System (Mechanical)

Referring to FIGS. 1, 2 and 5–7, the mechanical components of system C for controlling actuation of machine M center on a control handle generally indicated at 658, which is mounted in central housing portion 210 and extends transversely through sidewalls 212, being provided at each end with handle grips 660. Control handle 658 is mounted for rotation about its axis, whereby it controls propulsion, including forward and rearward travel, stopping, and rate of travel. It also is mounted for oscillation about the central longitudinal axis X—X of machine M (FIG. 3) with central control housing portion or section 210, thereby controlling turning of the machine and selective activation of the propulsion braking mechanisms. This rotation and oscillation can occur either separately or simultaneously.

For propulsion control, handle 658 is provided with a cam 662 held in place by a suitable through pin or the like 664, with the cam and handle being biased to the neutral position shown by torsion spring 666 surrounding handle 658. At its lower or left end, spring 666 is provided with a rearwardly disposed upper coil extension 668 hooked under a retaining pin 670 suitably secured to the inside of rear wall 218, and hooked over arm 668 is the inturned end of an upwardly and rearwardly inclined retaining arm 672 extending behind cam 662 and embedded in handle 658. At its upper or right end, spring 666 is provided with a rearwardly disposed lower coil extension arm 674 hooked over a retaining pin 676 suitably secured to the inside of rear wall 218, and engaging the underside of the hook end of arm 674 is the out-turned end of a downwardly and rearwardly extending retaining arm 678 embedded in handle 658.

Thus, as handle 658 is rotated forwardly about its own axis in a counter clockwise direction (FIG. 6), retaining arm 678 lifts spring extension arm 674 out of engagement with retaining pin 676 while coil extension 668 remains engaged under pin 670, even though retaining arm 672 rotates forwardly with handle 658. This action causes spring 666 to "windup" or tighten. Upon release of handle 658, spring 666 unwinds clockwise, whereby coil extension arm 674 returns retaining arm 678 to the position shown with extension arm 674 engaging over retaining pin 676. On the other hand, when handle 658 is rotated reversely about its axis, in a clockwise direction, retaining arm 672 on the handle moves spring extension 668 downwardly out of engagement with retaining pin 670, while coil extension arm 674 remains engaged over pin 676, even though retaining arm 674 rotates with handle 658. Such action, once again, causes spring 666 to "windup" or tighten, so that upon release, spring 666 again unwinds, but in a counter-clockwise direction, raising coil extension arm 668 and retaining arm 672 until engagement is remade with the underside of retaining pin 670 in the neutral position shown.

During such rotation of control arm 658, cam 662 causes roller cam follower 688 to reciprocate arm or rod 690 fore and aft through partition wall 692 against the bias of spring 694 bearing at its rear end against collar 696 on arm 690 and at its front end against the depending rear leg of, inverted L-shaped flange 698 suitably secured to adjacent side wall 212. Flange 698 also is provided with a lower horizontal rearwardly extending portion 699 for a purpose to be described below. At its forward end, arm 690 not only slides through depending rear leg of flange 698 but also terminates in an embedded wire 700 extending freely through an externally threaded sleeve 702 which passes through forward partition wall 704 and is adjustably held in position by washer 706 and nut 708, with the forwardly extending wire 700 being surrounded by a suitable sheath 710 and eventually connected to direction control mechanism 712 (FIG. 17), the mechanical connection between control handle 658 and direction control mechanism 712 being shown in FIG. 17 symbolically. Thus, forward (counter-clockwise) rotation of control handle 658 about its axis causes forward movement of machine M, while reverse (clockwise) rotation causes rearward machine movement, with the extent of rotation of handle 658, through direction control 712 and its associated electrical components in FIG. 17, controlling the speed of forward and reverse propulsion, to be described below.

As noted above, control handle 658 also is oscillatable with central control housing portion or section 219 about the central longitudinal axis X—X (FIG. 3) of machine M, and this type of movement controls turning of the machine by selective mechanical actuation of the propulsion braking mechanisms 256 (FIG. 8). For this purpose, upper rear partition wall 692 (FIGS. 5–7) is provided with a central longitudinal bolt 714 passing therethrough and held in place by nut 716, with bolt 714 also passing through upright support member 718, which is fixed at its lower end to top wall 208 of control housing 202 and spaced from partition wall 692 by washer 720, to complete the rear pivotal mounting of central housing section 210. The front pivotal mounting is composed of a headed pin 722 welded to and passing through a front upright support member 724 suitably fixed at its lower end to top wall 208 and through front partition wall 704. Once again, both control handle 658 and central control housing section 210 are biased to the horizontal position shown in the drawings by springs 726 mounted on each side of the central longitudinal axis X—X of machine M by pedestal blocks 728 (FIG. 2) on top wall 208 and connected at their upper ends to the under sides of internal flanges 730 on side walls 212.

Likewise, as shown in FIGS. 5 and 6, the rear upper ends of brake control cables 284 are provided with looped straps 732 or the like suitably mounted over L-shaped pins 734 having heads 736 at their rear ends and connected at their inwardly bent forward ends to the depending front flange 738 of an inverted U-shaped platform 740 provided with depending side flanges 742 connected adjacent their rear ends by transverse pivot pin 744 mounted through side walls 212. Intermediate its ends, platform 740 is provided with an upstanding rear lug 746 receiving the hooked forward end of a rearwardly extending link 748 having a downwardly depending rear end suitably extending through and pivotally secured to a transverse lever 750 pivoted to flange portion 699 by a bolt and nut connection generally indicated at 752 at one end. At its other end, lever 750 is provided with the inset inner end of rearwardly offset parking brake handle 754 extending outwardly through a J-shaped or bayonet type slot 756 in right side wall 212 of central control housing section 210.

As seen in FIG. 2, the adjustment for cable tension at the rear end of the machine is essentially the same as that at the forward end of the machine adjacent each brake mechanism (FIG. 8). Thus, threaded sleeve 286a corresponds to 286, adjusting lock nuts 290a correspond to lock nuts 290 for adjustably positioning sleeve 286a in bracket 288a, with couplings 292a corresponding to coupling 292 and sheath 294a corresponding to sheath 294.

Assuming that the operator wishes to turn machine M to the left (during forward or reverse travel or when stopped), by grasping handle grip 660, he depresses the left side of control handle 658 (FIG. 1) downwardly. This, of course, introduces slack into the left hand cable 284, which is crisscrossed with the right hand cable 284 as they pass through the frame of body B (not shown), so that the left hand cable connects to the right hand brake (not shown) and the right hand cable connects to the left hand brake (FIG. 8). Thus, the right hand cable is placed under tension to actuate the left hand brake mechanism 256 (FIG. 8) by pivoting link 272 clockwise to close brake shoe 260 and engage brake lining 258 frictionally with the adjacent surface of drum 232, thereby stopping propulsion of left hand wheel 222. At the same time, left hand brake cable 284 remains slack and right hand brake mechanism 256 remains disengaged, to permit continued movement of right hand wheel 222, permitting machine M to turn left. The reverse procedure is followed for turning machine M to the right, that is by depressing the right end of control handle 658 downwardly. This turning manipulation of control handle 658 simulates that applied to the steering wheel or the like in an automotive vehicle, boat or airplane, thereby requiring no special skill.

Assuming that the operator wishes to stop and park the machine, following release of control handle 658 (FIGS. 5–7) he pulls back on parking brake handle 754 which pivots lever 750 clockwise and moves link arm 748 to the rear, causing platform 740 to pivot upwardly and rearwardly, (clockwise) thereby placing both left and right brake cables 284 under tension to simultaneously engage each brake mechanism 256. To maintain these brake mechanisms in engaged position and park machine M, the operator then merely moves brake handle 754 from the rear lower dotted line position (FIG. 7) to the upper rear dotted line position in bayonet slot 756.

In addition, this parking brake mechanism can be used as a service brake to aid in controlling machine speed regardless of the rotative position of control handle 658 about either of the aforesaid axes, such as when ascending or descending an inclined surface. More particularly, it can be so used jointly with the turning mechanism, such as when descending a steep spiral ramp, overcoming the dynamic braking circuit to be described below. During such joint use, actuation of brake lever 754 applies tension to both cables 284 to engage both brake mechanisms 256, while depression of control handle 658 simultaneously applies additional tension to the appropriate one of the cables further engaging the appropriate one of such brake mechanisms for steering purposes.

Continuing with FIGS. 5–7, the solution control valve operating mechanism includes handle 758 freely passing through left side wall 212 and provided at its inner end with a lever arm or plate 760 which is pivotally mounted on the forwardly extending horizontal portion of flange 698 by means of bolt 762 and nut 764, with arm 760 being spaced above the flange by washer 766. At its right end, arm 760 is provided with a pivotal bolt and nut assembly generally indicated at 768 for securing the rear end of cable 467 passing rearwardly therethrough and forwardly through externally threaded sleeve 770 which also passes through front partition wall 704 and is adjustably secured in place by lock nuts 772 and washer 774. By manipulating handle 758, the operator can readily open and close detergent control valve 461 (FIG. 2) by means of lever 760, cable 467, pivotal yoke 466 connected to the front end of the cable (FIG. 2) and valve lever 464.

Sweeper Mechanism

Preferably, as best shown in FIGS. 1, 11 and 11a, machine M is provided with an advance sweeping mechanism SW for removing debris from the floor surface to be cleaned prior to the scrubbing and vacuuming operations. This sweeper mechanism, which may be detachably or permanently secured to the front end of body B in any suitable manner (not shown), includes a housing generally indicated at 776 having a rear wall 778, side walls 780 and front wall 782, both the side and front walls being stepped outwardly to form a U-shaped bumper 784 from which depends a similarly shaped skirt 786 spaced above the floor surface. The top wall 788 of housing 776 also includes an upstanding cupola or dome portion 790 which acts as a housing for sweeper drive motor 792 secured in place transversely by straps 794. This motor drives horizontal main brush 796, which extends transversely across the front of machine M within sweeper housing 776, and is mounted on axle 798 in bearings 800 provided in each of opposite side wall bumper portions 784. Brush 796 is driven by a belt 802 trained over a drive pulley 804 mounted on the output shaft 805 of motor 792 and one sheave of a double sheave driven pulley 806 mounted on brush shaft 798.

The auxiliary brush 808 is vertically mounted and driven by perpendicularly twisted belt 810 trained over the other sheave of pulley 806 and driven pulley 812 on vertical shaft 814 of auxiliary brush 808, such shaft extending upwardly through and being suitably mounted on a transversely extending horizontal wall 815 connected to front wall 782 and side walls 780, and provided with a downwardly and rearwardly inclined guard extension 816 having a flexible floor wiper flap or blade 817 to confine debris so that as shown in FIG. 11, counterclockwise rotation of auxiliary brush 808 throws such debris inwardly and rearwardly toward main brush 796, which rotates forwardly (counter-clockwise in FIG. 11a) to throw the debris forwardly and upwardly into a container or compartment formed by front wall 782, side walls 780, horizontal wall 815 and an intermediate vertical wall 818, over which the debris is thrown by main brush 796. For convenience top wall 788 may be provided with a movable cover 819 hinged as at 820 and lifted by knob 821 to provide access and removal of debris.

Sweeper mechanism SW is electrically operated from control system C at the rear of machine M, as will be described in greated detail below.

Power Source

As best shown in FIGS. 2 and 17, the preferred power source for machine M is a series of batteries generally indicated at 822 (FIG. 17), with two batteries being arranged in three upwardly and rearwardly stepped rows (only one battery in each row being illustrated in FIG. 2). Thus, in the lower front row, the batteries are indicated at 822*a* supported on tray 176, with those in the intermediate row being indicated at 822*b* and supported on tray 172, and those in the upper rear row being indicated at 822*c* supported on tray 168. As noted above, this stepped arrangement of batteries 822*a, b* and *c,* and of detergent tank 455 and vacuum tank 482 partially overlapped by batteries 822*b* and *c,* is designed to so distribute the weight of machine M that both the scrubber mechanism WS and vacuum mechanism V are supported in balanced cantilever fashion on propulsion wheels 222 and guide rollers 300 for ease of movement and maneuverability of machine M.

While any suitable power source could be employed for machine M, the D.C. multiple battery arrangement is preferred from an environmental standpoint. However, fossil fuel type power plants could be employed under proper ventilating and pollution control conditions, together with suitable generating and rectifying means converting the various electrical controls to a D.C. system. Likewise, an A.C. power source could be employed with appropriate transformer means to convert the control system to D.C. type.

Control System (Electrical)

Referring to FIG. 17, the electrical components of control system C include the 36 volt D.C. system (six 6 volt batteries wired in series) generally indicated at 822 as the power source, together with the main output and input (or return) lines 824, 826, with such power source being connected across such input and output lines by line 828.

Reading down the schematic diagram shown in FIG. 17, the first circuit is completed by line 830 including vacuum fan motor 518 and overload magnetic circuit breaker 558 arranged in series, the circuit breaker also serving as an on-off switch.

The second circuit is completed by line 832 containing series connected key switch 834, 10 amp fuse 836, master switch 838 and hour meter 840, the latter measuring the time of operation of the machine. Connected between master switch 838 and hour meter 840 is a secondary output line 842 for connection to a series of branch circuits, the first of which is completed by line 844 containing volt meter 846, which measures the voltage drop across the machine during operation.

The next branch circuit includes a double pole, double throw actuator switch generally indicated at 848, which switch is a rocker switch normally spring biased to an intermediate position, input line 850 connected to output line 842 and containing upper limit switch 454, and output line 852 connected to return line 826. The "up" ganged poles 854, 856 of actuator switch 848 selectively and simultaneously connect and disconnect with lines 850 and 852 respectively to close and open loop 858 formed by lines 860 and 862 connected to actuator motor 446 for articulating brushes 312 vertically. Likewise, this branch circuitry includes input line 864 connected to output line 842 and output line 866 connected to return line 826, with switch 848 including "down" ganged poles 868, 870 for selective and simultaneous connection to and disconnection from lines 864 and 866, the latter containing lower limit switch 404, thereby reversing current flow through loop 858 and motor 446.

Thus, when the operator moves actuator switch 848 to the "up" position, poles 854, 856 close lines 850 and 852 so that the current flows from line 850 through pole 854 and clockwise through loop 858 by lines 860, motor 446 and line 862 through pole 856 and output line 852 to return line 826. In this position, actuator motor is raising scrubber mechanism WS upwardly by retracting reciprocal actuator motor piston rod 444 (FIG. 2) to pivot bell crank lever forming plates 430 clockwise, thereby raising extensible link 402 and pivoting yoke links 392 counter-clockwise to lift support arms 390 and brush mounting platform 386. This movement continues until normally closed upper limit switch 454 is opened by engagement with pivot pin 442 or one of plates 430 (FIG. 2) to open line 850 (FIG. 17) and deenergize actuator motor 446. Alternatively, when actuator switch 848 is in the "down" position, current flows from input line 864 through pole 868 and counterclockwise through loop 858 via line 862, motor 446, line 860, pole 870 and output line 866 to return line 826. This downward movement of brushes 312, via extension of piston rod 444 and reversely moved linkage 430, 402 and 392, arms 390 and platform 386, continues until the proper scrubbing contact between brushes 312 and floor surface F is obtained, as indicated by a predetermined reading on ammeter 948, at which time the operator deactuates switch 848 from the "down" position to that shown. If maximum scrubbing contact is desired, then the downward movement continues until normally closed lower limit switch 404 on extensible link 402 is opened by cylinder 414 thereby deenergizing actuator motor 446.

The next circuitry includes a bi-directional motor control unit generally indicated at 872 and connected by line 874 across output and return lines 824, 826. The internal details of the various components of this motor control circuitry do not form part of this invention, and such components are commercially available from G. C. Controls, Binghamton, N.Y. Therefore, only so much of such motor control circuitry or unit will be described as is necessary for an understanding of the operation of inventive machine M.

Connected in line 874 is a power supply PS generally indicated at 876 having two combined inputs and outputs 878 and 880 connected respectively to direction control 712 and control logic and amplifier control 882, the former being mechanically connected (as noted above) to control handle 658. In turn, direction control unit 712 is provided with outputs 884 and 885 connected to control logic and amplifier control 882, which in turn, is provided with outputs 888 and 890, the former controlling the speed of propulsion and the latter the forward and reverse directions of propulsion. Output 888 is operatively associated with a speed controlling power transistor circuit generally indicated at 892 while output 890 is operatively associated with the control pairs 1–3 and 2–4 of direction controlling bridge circuit 894. A line 896 is connected to the input side of bridge 894 as well as to the input side of power supply 876 in line 874, with the output side of bridge circuit 894 being connected by line 898 to the input of transistor circuit 892, the output of which is connected by line 904 to line 874 on the output side of power supply 876.

The motor control unit also contains propulsion motor 248 which is connected across the control pairs of bridge circuit 894 by lines 906 and 908, with the latter containing overload circuit breaker (CB4) 910. Likewise, a dynamic braking circuit generally indicated at 912 and composed of series connected resistor 914 and normally closed relay contacts (R1) 916 is connected across the input and output sides of propulsion motor 248. In addition, the motor control unit includes a feedback loop composed of line 918 connected across the input and output sides of bridge circuit 894 and containing diode 920, to prevent a sudden surge of current flow through transistor circuit 892 when energizing or reversing motor 248. The bridge and feedback loop act as a plugging circuit for reversing motor 248.

An input line 922, which is connected to output branch line 842 at one end, includes the coil (R1) 924 of normally open relay contacts (R1) 916, and at its other end is connected to a time delay relay (TDR) 926 which, in turn is suitably connected by combined input and output line 886 to direction control 712 for a purpose to be described below.

Another circuit connecting branch output line 842 with control logic and amplifier control 882 of motor control unit 872 is formed by line 928 containing brush motor switch 930 and relay coil (R2) 932. The output end of line 928 is connected to a low voltage circuit breaker (LVCB) 934 in control logic and amplifier control 882, with the circuit breaker also being suitably connected across power supply (PS) 876 by combined input and output 880, as well as to the output 890 of control logic and amplifier control 882.

Still another circuit includes line 938 connected at one end to line 842 and at its other to line 928 downstream of coil 932, with line 938 including in series sweeper motor switch 940 and relay coil (R3) 942.

Next, the electrical control system components include line 944 connected across main lines 824 and 826 including the normally open contacts 946 of brush motor switch relay (R2) in series connection with ammeter 948, overload circuit breaker (CB2) 950 and right brush motor 382. Likewise, connected between return line 826 and line 944 between normally open relay contacts (R2) 946 and ammeter 948, is parallel circuit line 952 containing series connected overload circuit breaker (CB3) 954 and left brush motor 382.

The electrical components of control system C are completed by line 956 connected across main lines 824, 826 and including, in series, normally open relay contacts (R3) 958, sweeper motor 792 and overload circuit breaker (CB5) 960.

Location of Controls

As is apparent from FIG. 1, the various switches and meters are conveniently located at the rear of machine M for the convenience of a walk-behind operator. The volt meter 846 and hour meter 840 are located on the left top wall portion 208 of control housing 202, while ammeter 948, key switch 834 and on-off vacuum fan overload magnetic circuit breaker 558 are conveniently located on the right top wall portion 208 of control housing 206. Likewise, sweeper motor switch 940 and master on-off switch 838 are located side by side on top wall 214 of movable center control housing section 210, while the on-off brush motor switch 930 and the up-off-down scrubber actuator switch 848 are located side by side on inclined upper rear wall portion 216 of central control housing 210, with control handle 658 extending outwardly from either side of side walls 212.

Returning to FIG. 1, detergent control handle 758 is conveniently located forwardly of the left side of control handle 658, while parking and/or service brake handle 754 is conveniently located forwardly of the right side of such control handle. In addition, squeegee actuating handle grip 650 is conveniently located to the rear of the lower portion of control housing 202 below central control housing section 210, and below this is conveniently located the protruding knob 654 for adjustment of wiping pressure between squeegee 494 and floor surface F to be treated.

Operation

A typical overall operation of machine M now will be described with primary reference to FIGS. 1 and 17 of the drawings.

Assuming that the machine is off, the operator closes enabling key switch 834 provided as a security measure, as well as master switch 838, energizing both hour meter 840 and volt meter 846. He then lowers squeegee arm 572 to position squeegeee 494 in the proper wiping contact with floor surface F to be cleaned by manipulating handle grip 650 first downwardly and then upwardly in bayonet slot 205 to the position shown in FIG. 1. The operator closes magnetic circuit breaker 558 to actuate the vacuum fan motor 518 and closes brush motor switch 930, if open, to energize coil 932 which closes contacts 946 to actuate brush motors 382. Then, he actuates brush actuator motor 446 by closing "down" poles 868, 870 and their contacts of switch 848 to move brushes 312 vertically downwardly into proper operative floor scrubbing position, as indicated by a predetermined reading on ammeter 948, whereupon he "opens" such "down" poles and contacts.

Next, the operator actuates detergent control handle 758 to permit detergent to flow to brushes 312 and begin the wet scrubbing operation, with vacuum system V being previously energized to remove the dirty liquid propelled by brushes 312 to squeegee 494.

If necessary, the operator also closes sweeper motor switch 940, which energizes coil 942, closing contacts 958 in circuit 956 to energize sweeper motor 792, thereby actuating main and auxiliary brushes 796 and 808 respectively.

By turning or rotating control handle 658 forwardly, the machine is propelled in such direction to begin the overall floor treatment including the debris removal by sweeper mechanism SW, the wet scrubbing by scrubber mechanism WS and the drying operation by vacuum system V. Depending upon the extent to which control handle 658 is rotated forwardly about its axis, the strength of the signal through one of the outputs, say 884, of direction control 712 (FIG. 17) varies from weak to strong, the greater the rotation of control handle, the stronger such signal. Thus, output 888 of control logic and amplifier control unit 882 varies accordingly, so that power transistor unit 892 acts as a variable resistor in line 898 to increase the level of current flowing from bridge circuit 894 through propelling motor 248. At the same time, output 890 of control logic and amplifier control 882 determines the direction of current flow through bridge circuit 894 and motor 248 by means of control pair 1–3 or 2–4 of bridge circuit 894, with line 886 being disconnected within direction control 712.

Assuming that the operator wishes to stop machine M, he merely releases control handle 658, which is normally biased to the neutral position (FIGS. 5 and 6), whereupon cam 662, cam follower roller 688 and rod 690, together with cable 700, return to the position shown. In view of the fact that direction control 712 preferably is in the form of a magnetic slide, (not shown) outputs 884 and 885 are cut off, while line 886 is connected in circuit. This, in turn, cuts off outputs 888, 890 of control logic and amplifier control 882, thereby balancing bridge circuit 894, and energizes time delay relay 926, which momentarily delays energizing of coil 924 and closing of contacts 916 a purpose to be described below. Upon closing of contacts 916, the dynamic braking circuit shunts the current around motor 248 through resistor 914 which brings machine M to a smooth, quick stop, overcoming its momentum.

In the event the operator wishes to not only stop the machine but quickly change direction from forward to reverse (or vice versa), he reverses rotation of handle 658. Thus, as handle 658 passes through the neutral position, say from forward to reverse, direction control 712 cuts off output 884, momentarily connects line 886 in circuit and then energizes output 885. During the momentary energizing of time delay relay 926, coil 924 is not energized to close contacts 916 because of the built in time delay, thus locking out dynamic braking circuit 912. As a result, energizing of output 886 reenergizes outputs 888 and 890, with the latter unbalancing bridge circuit 894 in the opposite direction to reverse the current flow through motor 248, thereby providing a smooth transistor from forward to reverse movement of machine M.

Whenever the operator wishes to turn the machine in either direction of travel, he merely depresses the appropriate end of control handle 658 to mechanically engage brake mechanism 256 (FIG. 8) on the same side of machine M as the depressed handle side to place the appropriate crossed cable 284 under tension, such action automatically relaxing any tension on the other crossed cable 284.

Assuming that machine M has been in operation for such a long period that power source or supply 822 becomes inadequate to continue full operation of machine M, this being indicated by a drop below a predetermined value in the voltage measured by volt meter 846, control logic and amplifier control unit 882 automatically shuts down the machine. For this purpose, it is provided with low voltage circuit breaker 934 suitably connected across power supply 876 by combined input and output 880 for monitoring the voltage across source 882, as well as to outputs 888, 890. In addition circuit breaker 934 is connected by lines 928 and 938 to coils 932 and 942 respectively, and is pre-set to open when such voltage falls below such predetermined amount to deenergize motor 248 by cutting off outputs 888, 890, thereby causing machine M to stop. At the same time, opening of low voltage circuit breaker 934 automatically interrupts the circuits containing brush motor relay coil 932 and sweeper motor relay coil 942, thereby deenergizing the same to open their contacts 946 and 958 which shut down both brush motors 382 and sweeper motor 792 respectively.

As this occurs, the operator manipulates detergent handle 758 to close valve 461 (FIG. 2) and shut off the detergent supply, while vacuum fan motor 518 continues to run to pick up the dirty water left by brushes 312.

In order to reclose low voltage circuit breaker 934, it is necessary to open master switch 838 and reclose the same, thereby reenergizing brush motor coil 932 and sweeper motor coil 942. However, brush motors 382 and sweeper motor 792 will only energize momentarily, because once the voltage drops below the aforesaid predetermined value, low voltage circuit breaker 936 will reopen. To avoid this, the operator opens both brush motor switch 930 and sweeper motor switch 940 prior to reclosing master switch 838, thereby permitting the line voltage to rise above such predetermined value and reclose low voltage circuit breaker 934, to reactivate outputs 888, 890 of control logic and amplifier control 882. Thus, the operator will be able to continue propulsion of machine M by proper rotation of control handle 658, to reenergize propelling motor 248, say to clean up the residual dirty liquid left by now inactive brushes 312, and return machine M to a battery recharging location.

It is to be kept in mind that such predetermined voltage is set sufficiently high to permit continued operation of vacuum fan motor 518. In fact, such predetermined voltage setting could be sufficiently high to permit continued operation of brushes 382, in the event sweeper motor switch 940 is opened prior to reclosing of master switch 838, or in the alternative, should only a sweeping operation be desired, pending recharge of battery source 822, brush motor switch 930 could be opened prior to reclosing of master switch 838 to permit such sweeping operation, pending recharging of battery source 822.

It now will be seen how the invention accomplishes its various objectives, and various advantages of the invention likewise be apparent. While the invention has been described and illustrated herein by reference to a single preferred embodiment, it is to be understood that various changes and modifications may be made therein by one skilled in the art, with the scope of the invention being determined by the appended claims.

What is claimed is:

1. A floor cleaning machine including a body;

propulsion means capable of propelling said body in a generally forward direction over the surface of the floor to be cleaned;

scrubber means carried by said body for wetting and cleaning a width of the surface of the floor, said scrubber means including brush means; and vacuum means carried by said body for drying the cleaned surface, said vacuum means including a curved squeegee of a width slightly greater than the width of the surface of the floor cleaned by said brush means, and means mounting said squeegee immediately behind said brush means for swinging movement in response to turning movement of the floor cleaning machine about a generally vertically extended axis which passes through the mid portion of said brush means, whereby said squeegee properly tracks said brush means to insure that virtually all water deposited on the floor by the scrubber means is picked up.

2. An automatic, self-contained and self-propelled walk behind floor cleaning machine including a body;

propulsion means capable of propelling said body in a generally forward direction over the surface of the floor to be cleaned, said propulsion means including ground engaging wheels;

scrubber means carried by said body for wetting and cleaning a width of the surface of the floor, said scrubber means including brush means, and said scrubber means being mounted behind said ground engaging wheels;

vacuum means carried by said body for drying the cleaned surface, said vacuum means including a curved squeegee of a width slightly greater than the width of the surface of the floor cleaned by said brush means, and means mounting said squeegee immediately behind said brush means and for swinging movement about a generally vertically extending axis in response to turning movement of the floor cleaning machine whereby said squeegee properly tracks said brush means to insure that virtually all water deposited on the floor by the scrubber means is picked up; and control means operably associated with said propulsion means, scrubber means and vacuum means and including controls located to the rear of the body and engageable by a walk behind operator.

3. The floor cleaning machine as set forth in claim 1 or 2 wherein the means mounting said squeegee includes a ball joint construction disposed immediately above a midportion of said brush means.

4. The floor cleaning machine as set forth in claim 1 or 2 wherein said brush means includes a pair of rotary brushes rotatable about vertical axes, each rotary brush being driven by an electric motor mounted above said brush, and wherein the means of mounting the squeegee includes a pivot assembly disposed midway between said electric motors.

5. The floor cleaning machine as set forth in claim 4 further characterized by provision of first and second means capable of raising and lowering said scrubber means and said curved squeegee, respectively.

* * * * *